US012760459B2

(12) United States Patent
Yong et al.

(10) Patent No.: US 12,760,459 B2
(45) Date of Patent: Oct. 13, 2026

(54) LAUNDRY TREATING APPARATUS

(71) Applicant: LG ELECTRONICS INC., Seoul (KR)

(72) Inventors: Ho Yong, Seoul (KR); Doo Hyun Kim, Seoul (KR); Deok Won Kang, Seoul (KR); Jeongkon Kim, Seoul (KR); Jun Hee Lee, Seoul (KR); Jungwon Kim, Seoul (KR)

(73) Assignee: LG Electronics inc., Seoul (KR)

( * ) Notice: Subject to any disclaimer, the term of this patent is extended or adjusted under 35 U.S.C. 154(b) by 179 days.

(21) Appl. No.: 18/731,531

(22) Filed: Jun. 3, 2024

(65) Prior Publication Data

US 2024/0318367 A1 Sep. 26, 2024

Related U.S. Application Data

(63) Continuation of application No. 18/198,543, filed on May 17, 2023, now Pat. No. 12,043,938, which is a (Continued)

(30) Foreign Application Priority Data

Jul. 3, 2020 (KR) ..... 10-2020-0082116
Jul. 6, 2020 (KR) ..... 10-2020-0083069
(Continued)

(51) Int. Cl.
*D06F 25/00* (2006.01)
*D06F 39/04* (2006.01)
*D06F 58/26* (2006.01)

(52) U.S. Cl.
CPC ..... *D06F 25/00* (2013.01); *D06F 39/04* (2013.01); *D06F 58/26* (2013.01)

(58) Field of Classification Search
CPC ..... D06F 25/00
See application file for complete search history.

(56) References Cited

U.S. PATENT DOCUMENTS 5,146,693 A 9/1992 Dottor et al.
5,983,520 A 11/1999 Kim et al.
(Continued)

FOREIGN PATENT DOCUMENTS

CN 1834333 A 9/2006
CN 1955364 A 5/2007
(Continued)

OTHER PUBLICATIONS

Extended European Search Report in European Appln. No. 23209962.2, mailed on Feb. 29, 2024, 6 pages.
(Continued)

*Primary Examiner* — Jason Y Ko
(74) *Attorney, Agent, or Firm* — Fish & Richardson P.C.

(57) ABSTRACT

A laundry treating apparatus, which can perform a laundry drying function, includes a tub in which washing water is accommodated, a drum rotatably installed in the tub, a duct installed on the tub and provided with an air-intake port and an air-inflow port for a flow of air, a blower fan installed in the duct to form the flow of air between the air-intake port and the air-inflow port, a heat exchanger installed in the duct so as to be supplied with cooling water and configured to perform heat exchange so as to cool the air transferred along an inside of the duct, and a heater installed in the duct to heat the air transferred along the inside of the duct.

20 Claims, 28 Drawing Sheets

Related U.S. Application Data continuation of application No. 17/366,764, filed on Jul. 2, 2021, now Pat. No. 11,692,292.

(30) Foreign Application Priority Data

| | | |
|---|---|---|
| Nov. 2, 2020 | (KR) | 10-2020-0144466 |
| Mar. 29, 2021 | (KR) | 10-2021-0040696 |
| Mar. 29, 2021 | (KR) | 10-2021-0040697 |
| Mar. 29, 2021 | (KR) | 10-2021-0040703 |

(56) References Cited

U.S. PATENT DOCUMENTS

| | | | |
|---|---|---|---|
| 2010/0132216 | A1 | 6/2010 | Krausch et al. |
| 2016/0083896 | A1 | 3/2016 | Ryoo et al. |

FOREIGN PATENT DOCUMENTS

| | | | |
|---|---|---|---|
| CN | 101701404 | A | 5/2010 |
| CN | 104487621 | A | 4/2015 |
| CN | 105544164 | A | 5/2016 |
| CN | 105671850 | A | 6/2016 |
| CN | 106012457 | A | 10/2016 |
| CN | 107787383 | A | 3/2018 |
| CN | 107815812 | | 3/2018 |
| CN | 109750443 | A | 5/2019 |
| EP | 1734170 | | 1/2009 |
| EP | 2241663 | | 10/2010 |
| EP | 2241663 | A1 | 10/2010 |
| EP | 3190225 | A1 | 7/2017 |
| EP | 3241944 | | 11/2017 |
| EP | 3241944 | A1 | 11/2017 |
| JP | H09-173680 | A | 7/1997 |
| JP | 2005065907 | | 3/2005 |
| JP | 2006115950 | A | 5/2006 |
| JP | 2007-275444 | A | 10/2007 |
| JP | 2008-006123 | A | 1/2008 |
| JP | 2011-010710 | | 1/2011 |
| JP | 2013-158650 | | 8/2013 |
| KR | 10-1998-0017703 | | 6/1998 |
| KR | 10-2005-0097277 | A | 10/2005 |
| KR | 10-2005-0099252 | A | 10/2005 |
| KR | 10-2005-0118480 | A | 12/2005 |
| KR | 10-2006-0098832 | A | 9/2006 |
| KR | 10-2008-0051878 | | 6/2008 |
| KR | 10-2010-0032225 | A | 3/2010 |
| KR | 10-2012-0014531 | A | 2/2012 |
| KR | 10-2012-0040380 | | 4/2012 |
| KR | 10-2012-0113363 | A | 10/2012 |
| KR | 10-2014-0100227 | | 8/2014 |
| KR | 10-2015-0074597 | A | 7/2015 |
| KR | 10-2015-0081602 | | 7/2015 |
| KR | 10-2016-0116465 | | 10/2016 |
| KR | 10-2017-0069461 | | 6/2017 |
| KR | 10-2017-0082045 | | 7/2017 |
| KR | 10-2017-0082058 | | 7/2017 |
| KR | 10-2018-0027041 | A | 3/2018 |
| KR | 10-2018-0027043 | | 3/2018 |
| KR | 10-2018-0048513 | A | 5/2018 |

OTHER PUBLICATIONS

Office Action in Chinese Appln. No. 202110718468.4, mailed on Sep. 7, 2023, 19 pages (with English translation).

Office Action in Japanese Appln. No. 2022-580855, mailed on Feb. 20, 2024, 6 pages (with English translation).

Notice of Allowance in Korean Appln. No. 10-2020-0083069, mailed on May 16, 2025, 6 pages (with English 4 translation).

Extended European Search Report in European Appln. No. 21183421.3, dated Nov. 26, 2021, 8 pages.

International Search Report in International Appln. No. PCT/KR2021/007683, dated Sep. 29, 2021, 8 pages (with English translation).

Office Action in Chinese Appln. No. 202110718468.4, mailed on Apr. 13, 2023, 19 pages (with English translation).

Notice of Allowance in Japanese Appln. No. 2022-580855, mailed on Aug. 16, 2024, 5 pages (with English translation).

Office Action in Korean Appln. No. 10-2021-0040696, mailed on Jan. 26, 2026, 12 pages (with English translation).

Office Action in Korean Appln. No. 10-2021-0040697, mailed on Feb. 2, 2026, 12 pages (with English translation).

Office Action in Korean Appln. No. 10-2021-0040703, mailed on Feb. 3, 2026, 10 pages (with English translation).

LAUNDRY TREATING APPARATUS

CROSS REFERENCE TO RELATED APPLICATIONS

The present application is a continuation of U.S. application Ser. No. 18/198,543, filed on May 17, 2023, which is a continuation of U.S. application Ser. No. 17/366,764, filed on Jul. 2, 2021, which claims the benefit of priority to Korean Patent Application Nos. 10-2020-0083069, filed on Jul. 6, 2020, 10-2020-0082116, filed on Jul. 3, 2020, 10-2020-0144466, filed on Nov. 2, 2020, 10-2021-0040696, filed on Mar. 29, 2021, 10-2021-0040697, filed on Mar. 29, 2021, and 10-2021-0040703, filed on Mar. 29, 2021. The disclosures of the prior applications are incorporated by reference in their entirety.

TECHNICAL FIELD

The present disclosure relates to a laundry treating apparatus, and more particularly, to a laundry treating apparatus including a drying function for laundry.

BACKGROUND

In general, a laundry treating apparatus treats laundry by applying physical and chemical actions to the laundry. The term "laundry treating apparatus" may be used to collectively refer to a washing apparatus that removes contaminants from laundry, a dehydration apparatus that dehydrates laundry by rotating a washing tub containing laundry at high speed, a drying apparatus that dries wet laundry by applying hot air into a washing tub, and the like.

Laundry treating apparatuses are not limited to separate apparatuses that performs one of a washing function, a dehydration function, and a drying function. In some examples, laundry treating apparatuses may be configured to perform some or all of the above-mentioned functions in one laundry treating apparatus.

Some laundry treating apparatuses may automatically perform a washing course, a rinsing course, a dehydration course, and a drying course in order, without a user's manipulation before, between, or during these courses.

A laundry treating apparatus having a drying function is configured to supply hot and dry air into a tub and a drum in order to dry laundry. The supplied hot and dry air may absorb moisture from the laundry and dry the laundry.

In this case, the laundry treating apparatus may discharge, from the tub, the air that has absorbed the moisture and become in a relatively low-temperature and high-humidity state. The discharged air may be circulated in such a way that the moisture is removed from the discharged air, heated, and then re-supplied into the tub.

Accordingly, a laundry treating apparatus including a drying function employs a configuration for removing moisture from air, a configuration for heating air, and a configuration for circulating air.

In some examples, a laundry treating apparatus including a drying function includes a drying apparatus and a laundry dryer including the same.

Specifically, such a laundry treating apparatus may include, among other things, (i) a cabinet including an inlet through which external air is introduced, (ii) a drum disposed inside the cabinet and accommodating an object to be dried, (iii) a condensation duct provided to condense moisture in the air introduced from the inside of the drum, (iv) an outlet port communicating with the condensation duct to discharge some of the air introduced from the condensation duct, (v) a drying duct connected to the condensation duct, the inlet, and the drum so as to heat some of the air introduced from the condensation duct and the external air introduced through the inlet and to supply the heated air to the inside of the drum.

Such a laundry treating apparatus may include a condensation duct for removing moisture in the air discharged from the tub, and the condensation duct is disposed on the rear surface of the tub. In this structure, in order to secure an arrangement space for the condensation duct, the size of the tub needs to be reduced in the limited space in the cabinet.

On the other hand, the size of the tub is desired to be relatively large in order to satisfy need of consumers who prefer large capacity laundry treating apparatuses. However, the laundry treating apparatus described above does not meet such need in terms of increasing the size of the tub.

In other examples, a laundry treating apparatus includes a dryer.

Specifically, such a laundry treating apparatus may include (i) a main body, (ii) a drying chamber provided inside the main body so as to accommodate an object to be dried, (iii) a supply unit configured to supply fluid generated from an external heat source into the main body, (iv) a heat exchange unit connected to the supply unit and configured to heat air through heat exchange with the fluid supplied from the supply unit, (v) a drying duct configured to guide the heated air to the drying chamber, (vi) a heater installed on the front surface of the heat exchange unit and (vii) a blower apparatus configured to circulate air inside the drying chamber and the drying duct.

In such a laundry treating apparatus, the blower apparatus, the heat exchange unit, and the heater may be all installed in one drying duct disposed on the top surface of the drying chamber. In addition to the heater, the heat exchange unit installed in the drying duct may additionally heat the air because it uses an external heat source.

Further, the above laundry treating apparatus does not have a component for condensing moisture in the circulating air installed in the drying duct. Moisture in the air is condensed as it is circulated through a condensation duct and a condenser disposed on the rear surface of the drying chamber.

Therefore, the laundry treating apparatus described above needs to separately secure a space for arranging the condensation duct for condensing moisture.

As described above, the laundry treating apparatuses including a drying function for laundry have several shortcomings that need to be addressed in order to efficiently perform the drying function without restricting the specifications of main components such as a tub. In addition, it is desired to address such shortcomings of laundry treating apparatuses to secure price competitiveness and to enable efficient installation of main components such as a heat exchanger in a limited space. However, the laundry treating apparatuses described above do not address the above-described shortcomings.

SUMMARY

The present disclosure is directed to addressing the above-described shortcomings associated with laundry treating apparatuses including a drying function.

Specifically, the present disclosure is directed to providing a laundry treating apparatus including a drying function, wherein the laundry treating apparatus is capable of realizing a larger capacity by optimizing the arrangement of components for removing moisture from air, components for heating the air, and components for circulating the air, which are used in the laundry treating apparatus.

In addition, the present disclosure is directed to providing a laundry treating apparatus including a drying function, wherein the laundry treating apparatus is capable of effectively removing moisture from circulated air by allowing moisture in the air to be smoothly condensed, while having a further simplified heat exchange structure.

In addition, the present disclosure is directed to providing a laundry treating apparatus including a drying function, wherein the laundry treating apparatus is capable of further improving laundry drying efficiency by enabling a process for removing moisture from air and a process of heating the air to be performed in an optimal sequence.

In addition, the present disclosure is directed to providing a laundry treating apparatus including a drying function, wherein a laundry drying function can be smoothly implemented without being deteriorated, by minimizing the adhesion of foreign substances, such as lint generated during the process of drying laundry, with respect to main components of the laundry treating apparatus.

The present disclosure is not limited to what has been described above, and other aspects, which are not described above, will be clearly understood by a person ordinarily skilled in the related art to which the present disclosure belongs.

Particular implementations of the present disclosure provide a laundry treating apparatus that includes a tub configured to receive washing water, a drum positioned in the tub and configured to rotate relative to the tub, a duct positioned at the tub and having an air-intake port and an air-inflow port, a blower fan positioned at the duct and configured to create airflow between the air-intake port and the air-inflow port, a heat exchanger positioned in the duct and configured to receive cooling water, the heat exchanger configured to cool air transferred along an inside of the duct, and a heater positioned in the duct and configured to heat the air transferred along the inside of the duct.

In some implementations, the laundry treating apparatus can optionally include one or more of the following features. The heat exchanger may be positioned between the blower fan and the heater. The blower fan may be configured to create the airflow in a direction from the air-intake port towards the air-inflow port via the heat exchanger and the heater in order. The heat exchanger may be spaced apart from the heater at a first distance between 2.5 cm and 7 cm. The first distance between the heat exchanger and the heater may be smaller than a second distance between the blower fan and the heat exchanger. The heat exchanger may include a pipe having a shape of a loop coil and configured to permit the cooling water to pass therethrough, a water supply port configured to introduce the cooling water into the pipe, and a drain port configured to discharge the cooling water from the pipe. At least a portion of the pipe may be made of a material comprising at least one of stainless steel, a copper alloy, an aluminum alloy, or a nickel alloy. The water supply port may be disposed closer to the air-inflow port than to the air-intake port in a plan view. The drain port may be disposed closer to the air-intake port than to the air-inflow port in the plan view. The water supply port and the drain port may be oriented in a same direction with respect to the pipe. The pipe may have a central axis around which the pipe extends in a spiral shape along a direction of the airflow. The heater may include a radiator extending in a zigzag shape along the direction of the airflow. The duct may include at least one gasket positioned at a side surface of a portion of the duct at which the heat exchanger is disposed. Each of the water supply port and the drain port may extend through the at least one gasket. Any one of an uppermost end and a lowermost end of the water supply port may be located at a height between an uppermost end and a lowermost end of the drain port. The drain port may be fluidly connected to the tub to thereby introduce the cooling water discharged from the drain port into the tub. A surface of the drum may be configured to function as a condensing surface based on the cooling water being introduced into the tub. The cooling water may be configured to flow down along a rear surface of the tub. The duct may include a heat exchanger base that supports a bottom surface of the heat exchanger, and a heat exchanger cover that covers a top surface of the heat exchanger. The heat exchanger may include a water supply port exposed to an outside of the duct and configured to introduce the cooling water into the water supply port, and a drain port exposed to the outside of the duct and configured to discharge the cooling water through the drain port. The water supply port and the drain port may be oriented in a same direction at at least one of the heat exchanger base or the heat exchanger cover. The duct may include at least one sealing part positioned at at least one portion of the duct at which each of the water supply port and the drain port is exposed to the outside of the duct. The heat exchanger base may include an inclined surface configured to guide a condensed water or cleaning water toward a cleaning water discharge hole.

In view of the foregoing, a laundry treating apparatus according to an aspect of the present disclosure is configured to optimize the structure of a duct assembly installed on a tub to guide air discharged from the tub and re-introduce the air into the tub. Specifically, in addition to a blower fan and a heater, a water-cooled heat exchanger configured to perform heat exchange so as to cool air is also installed inside a duct installed on the tub, so that a separate space for condensing moisture in the air is not required.

In addition, a laundry treating apparatus according to an aspect of the present disclosure is configured to further simplify a condenser configured to condense moisture in the air. Specifically, a water-cooled heat exchanger configured to exchange heat with air through supplied cooling water is disposed inside the duct so as to further simplify the heat exchange structure.

In addition, the laundry treating apparatus according to an aspect of the present disclosure is configured to more efficiently condense and heat the air circulated for drying laundry. Specifically, moisture is first removed from the air that is transferred along the inside of the duct by the blower fan, in the heat exchanger, and then the air is heated by the heater so that the air is re-introduced into the tub in a hot and dry state.

In addition, in the laundry treating apparatus according to an aspect of the present disclosure, since the heat exchanger and the heater are spaced apart from each other, it is possible to restrict heat emitted from the heater from affecting the function of the heat exchanger.

In addition, in the laundry treating apparatus according to an aspect of the present disclosure, since the blower fan and the heater are spaced apart from each other and the heat exchanger is disposed in this separation space, it is possible to restrict the heat emitted from the heater from damaging injection-molded products of the blower fan, a motor, or the like.

In addition, in the laundry treating apparatus according to an aspect of the present disclosure, it is possible to use some of washing water as cooling water without a separate component for supplying cooling water to the heat exchanger.

In addition, in the laundry treating apparatus according to an aspect of the present disclosure, cooling water is capable of flowing into a pipe having a loop coil shape, and is capable of exchanging heat with air outside the pipe.

In addition, in the laundry treating apparatus according to an aspect of the present disclosure, cooling water is capable of flowing into a pipe made of a corrosion-resistant material and is capable of exchanging heat with air outside the pipe.

In addition, in the laundry treating apparatus according to an aspect of the present disclosure, a heat exchanger portion into which cooling water is introduced may be disposed behind a heat exchanger portion from which cooling water is discharged, with respect to an air movement path inside the duct.

In addition, in the laundry treating apparatus according to an aspect of the present disclosure, a portion of the heat exchanger exposed to the outside of the duct may be supported by a gasket disposed on a portion of the duct.

In addition, in the laundry treating apparatus according to an aspect of the present disclosure, when there are a plurality of parts of the heat exchanger exposed to the outside of the duct, the corresponding parts may be disposed at the same or partially overlapping heights.

In addition, in the laundry treating apparatus according to an aspect of the present disclosure, cooling water discharged from the heat exchanger may be injected into the tub and processed without a separate discharge structure.

In addition, in the laundry treating apparatus according to an aspect of the present disclosure, cooling water discharged from the heat exchanger may be used to condense moisture on the surface of the drum by injecting the cooling water into the tub.

In addition, in the laundry treating apparatus according to an aspect of the present disclosure, it is possible to minimize the introduction of foreign substances into the duct by collecting the foreign substances in the air discharged from the tub.

In addition, in the laundry treating apparatus according to an aspect of the present disclosure, by cleaning a filter that collects foreign substances in the air, it is possible to restrict the accumulation of foreign substances in the filter itself.

In addition, in the laundry treating apparatus according to an aspect of the present disclosure, some of the cooling water may be used as filter cleaning water, without a separate component for supplying filter cleaning water to a filter cleaner.

Aspects of the present disclosure are not limited to those described above, and other aspects not described above will be clearly understood by a person ordinarily skilled in the art to which the present disclosure belongs from the description below.

The effects of the laundry treating apparatus according to the present disclosure will be described below.

According to at least one of the embodiments of the present disclosure, in addition to the blower fan and the heater, the water-cooled heat exchanger configured to exchange heat to cool air is also installed inside the duct installed on the tub, without requiring a separate space for condensation of moisture in the air. Thus, it is possible to reduce restrictions associated with implementing the laundry treating apparatus in a large capacity.

In addition, according to at least one of the embodiments of the present disclosure, by disposing, in the duct, a water-cooled heat exchanger that exchanges heat with air using supplied cooling water, the heat exchange structure is further simplified. Thus, it is possible to smoothly remove moisture while also reducing the components for moisture condensation in the air.

In addition, according to at least one of the embodiments of the present disclosure, moisture is first removed from the heat exchanger from the air transferred along the inside of the duct through the blower fan, and then the air is heated in the heater. Thus, it is possible to further improve drying efficiency for laundry by preventing a situation in which the heated air is cooled again.

In addition, according to at least one of the embodiments of the present disclosure, the heat exchanger and the heater are spaced apart from each other, and the heat emitted from the heater does not affect the function of the heat exchanger. Thus, it is possible to secure the reliability of the heat exchanger, which would otherwise be deteriorated due to an increase in temperature of the heat exchanger itself.

In addition, according to at least one of the embodiments of the present disclosure, the blower fan and the heater are spaced apart from each other, and the heat exchanger is disposed in this separation space. Thus, heat emitted from the heater does not damage the injection-molded products of the blower fan, the motor, or the like, and thus it is possible to restrict the disruption of air circulation due to the deterioration of the function of the blower fan.

In addition, according to at least one of the embodiments of the present disclosure, some of the washing water is used as cooling water, without a separate component for supplying cooling water to the heat exchanger. Thus, it is possible to further simplify the structure of the heat exchanger, such that the degree of freedom of arrangement of the heat exchanger can be improved.

In addition, according to at least one of the embodiments of the present disclosure, cooling water flows into the loop coil-shaped pipe and exchanges heat with air outside the pipe. Thus, it is possible to improve heat exchange efficiency relative to the area occupied by the heat exchanger in the duct.

In addition, according to at least one of the embodiments of the present disclosure, cooling water flows into the pipe made of a corrosion-resistant material, and exchanges heat with air outside the pipe. Thus, it is possible to restrict sanitation problems of the laundry treating apparatus due to corrosion of the heat exchanger, etc.

In addition, according to at least one of the embodiments of the present disclosure, the portion of the heat exchanger into which cooling water is introduced is disposed behind the portion of the heat exchanger from which cooling water is discharged, with respect to the air movement path inside the duct. Thus, it is possible to increase the efficiency of the heat exchanger by cooling the air flow path up to the rearmost portion using the lowest temperature cooling water.

In addition, according to at least one of the embodiments of the present disclosure, the portion of the heat exchanger exposed to the outside of the duct is supported by the gasket disposed on a portion of the duct. Thus, cooling water can be smoothly circulated while maintaining airtightness between the inside and the outside of the duct.

In addition, according to at least one of the embodiments of the present disclosure, when there are a plurality of parts of the heat exchanger exposed to the outside of the duct, the corresponding parts are disposed at the same or partially overlapping heights. Thus, it is easier to assemble the heat exchanger and the duct In addition, according to at least one of the embodiments of the present disclosure, the cooling water discharged from the heat exchanger is injected into the tub and processed without a separate discharge structure. Thus, it is possible to further simplify the structure of the heat exchanger, such that the degree of freedom of arrangement of the heat exchanger can be improved.

In addition, according to at least one of the embodiments of the present disclosure, the cooling water discharged from the heat exchanger is injected into the inside of the tub and used to condense moisture on the surface of the drum. Thus, it is possible to additionally remove moisture in the air, in addition to moisture condensation performed in the duct.

In addition, according to at least one of the embodiments of the present disclosure, foreign substances in the air discharged from the tub are collected so as to minimize the inflow of foreign substances into the duct. Thus, it is possible to restrict the laundry drying function from being deteriorated due to the adhesion of foreign substances to the main components in the duct.

In addition, according to at least one of the embodiments of the present disclosure, the filter that collects foreign substances in the air is washed so as to restrict the foreign substances from accumulating in the filter itself. Thus, it is possible to improve the efficiency of collecting foreign substances while enabling smooth air circulation.

In addition, according to at least one of the embodiments of the present disclosure, some of the cooling water is used as filter cleaning water, without a separate component for supplying filter cleaning water to the filter cleaner. Thus, it is possible to further simplify the structure of the filter cleaner so that the space in which the filter cleaner is installed can be minimized.

BRIEF DESCRIPTION OF THE DRAWINGS

For the purpose of illustrating the present disclosure, there is shown in the drawings an exemplary embodiment, it being understood, however, that the present disclosure is not intended to be limited to the details shown because various modifications and structural changes may be made therein without departing from the spirit of the present disclosure and within the scope and range of equivalents of the claims. The use of the same reference numerals or symbols in different drawings indicates similar or identical items.

DETAILED DESCRIPTION

Figure 1:
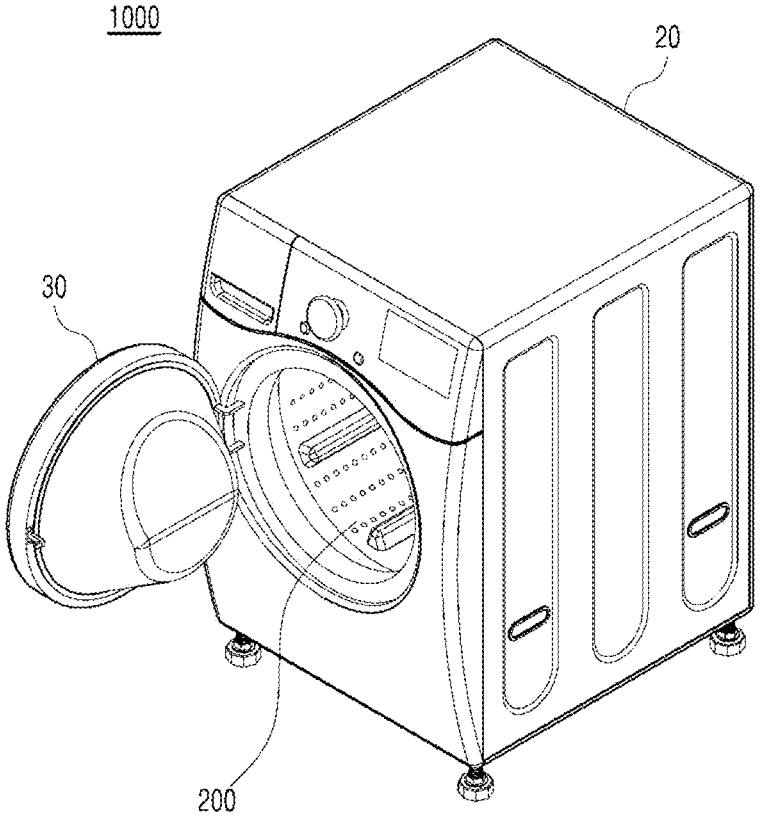
FIG. 1 is a perspective view illustrating a laundry treating apparatus according to an embodiment of the present disclosure.

Hereinafter, preferable exemplary embodiments of the present disclosure will be described in detail referring to the attached drawings. However, description of known functions or configurations will be omitted in the following description in order to clarify the gist of the present disclosure. Like reference numerals designate like elements throughout the specification.

Figure 2:
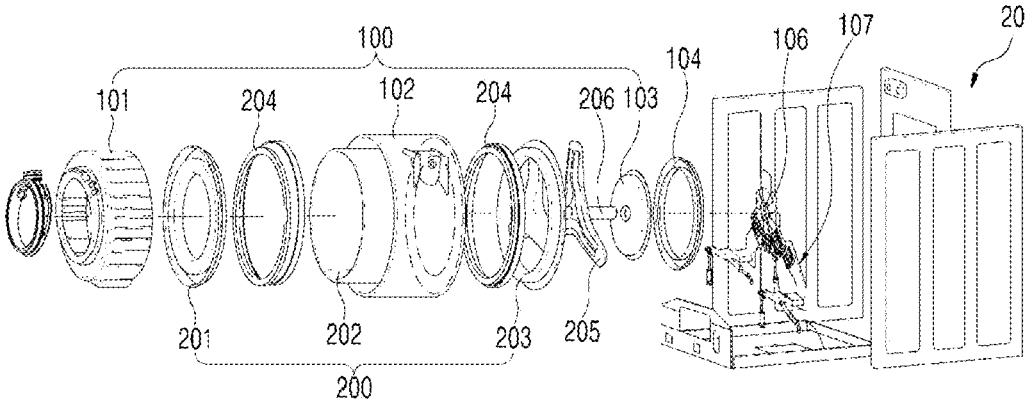
FIG. 2 is an exploded perspective view illustrating the laundry treating apparatus.

FIG. 1 is a perspective view illustrating a laundry treating apparatus according to an embodiment of the present disclosure. FIG. 2 is an exploded perspective view illustrating the laundry treating apparatus according to an embodiment of the present disclosure.

As illustrated in FIGS. 1 and 2, a laundry treating apparatus 1000 according to an embodiment of the present disclosure includes a cabinet 20 forming an exterior, a tub 100 installed inside the cabinet 20 to accommodate washing water, and a drum 200 rotatably installed inside the tub 100 to accommodate laundry.

A front portion of the cabinet 20 defines a laundry inlet through which laundry is put into the drum 200. The laundry inlet can be opened/closed by a door 30 installed on the front portion of the cabinet 20.

The tub 100 includes a front tub 101 and a rear tub 102 forming the front and rear sides, and a tub back 103 forming the rear wall of the rear tub 102.

The rear tub 102 has an opening at the rear side thereof. A rear gasket 104, which is a flexible member, is coupled to the opening. The tub back 103 is radially connected to the rear gasket 104 at an inner side of the rear gasket 104. A rotary shaft 206 (described further below) is inserted through the tub back 103.

The rear gasket 104 is sealingly connected to each of the tub back 103 and the rear tub 102 so as to restrict the washing water in the tub 100 from leaking. The tub back 103 may vibrate together with the drum 200 when the drum 200 rotates. However, the rear gasket 104 is flexibly deformable, which allows for relative movement of the tub back 103 without interfering with the rear tub 102.

In some implementations, the rear gasket 104 may have a curved portion or a corrugated portion that extends to a length sufficient to allow the relative movement of the tub back 103.

The drum 200 includes a drum front 201, a drum center 202, and a drum back 203. A balancer 204 is installed at each of the front side and the rear side of the drum 200. The drum back 203 is connected to a spider 205, and the spider 205 is connected to the rotary shaft 206.

The drum 200 can be rotated in the tub 100 by a rotational force transmitted via the rotary shaft 206. The drum 200 has a plurality of through holes in the circumferential surface thereof in order to discharge washing water generated from laundry during washing or dehydration.

A bearing housing 106 is coupled to the rear surface of the tub back 103. In addition, the bearing housing 106 rotatably supports the rotary shaft 206 between the motor and the tub back 103. The bearing housing 106 is supported against the cabinet 20 by a suspension unit 107.

Figure 3:
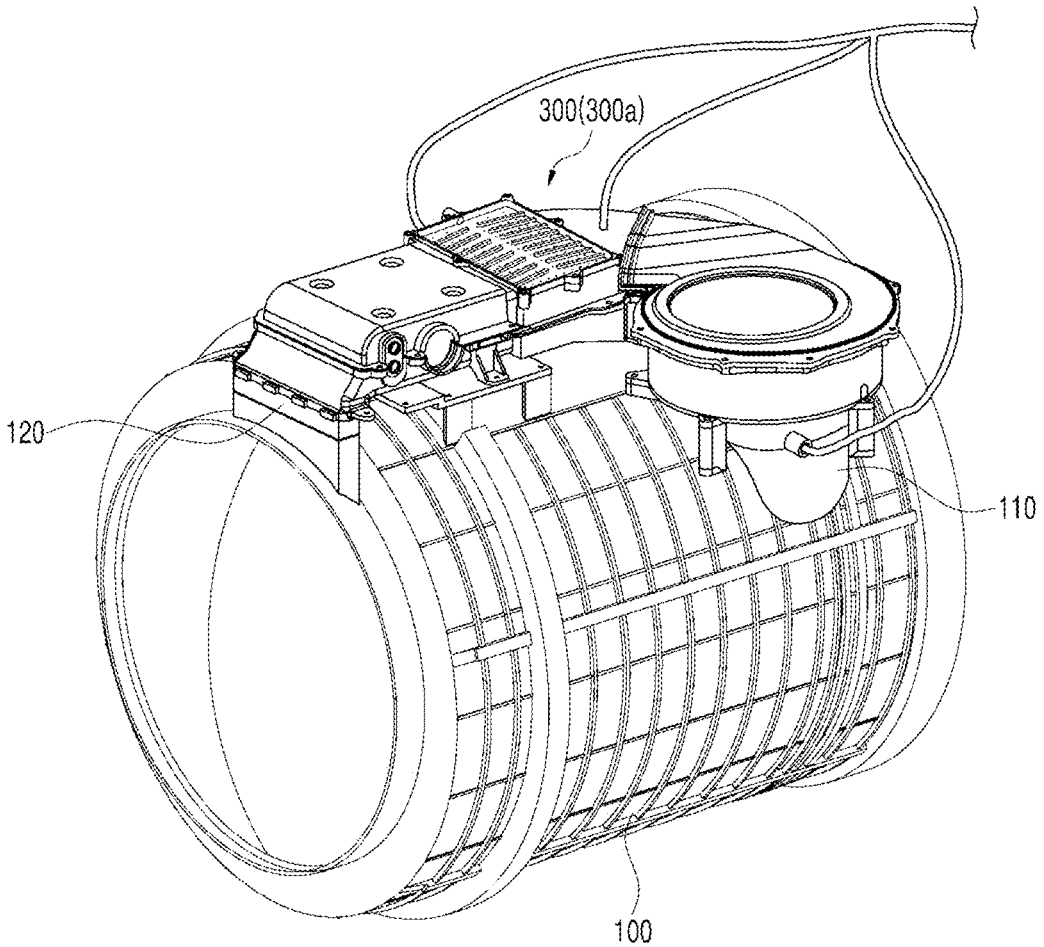
FIG. 3 is a perspective view illustrating an example duct assembly installed in a tub in the laundry treating apparatus.
Figure 4:
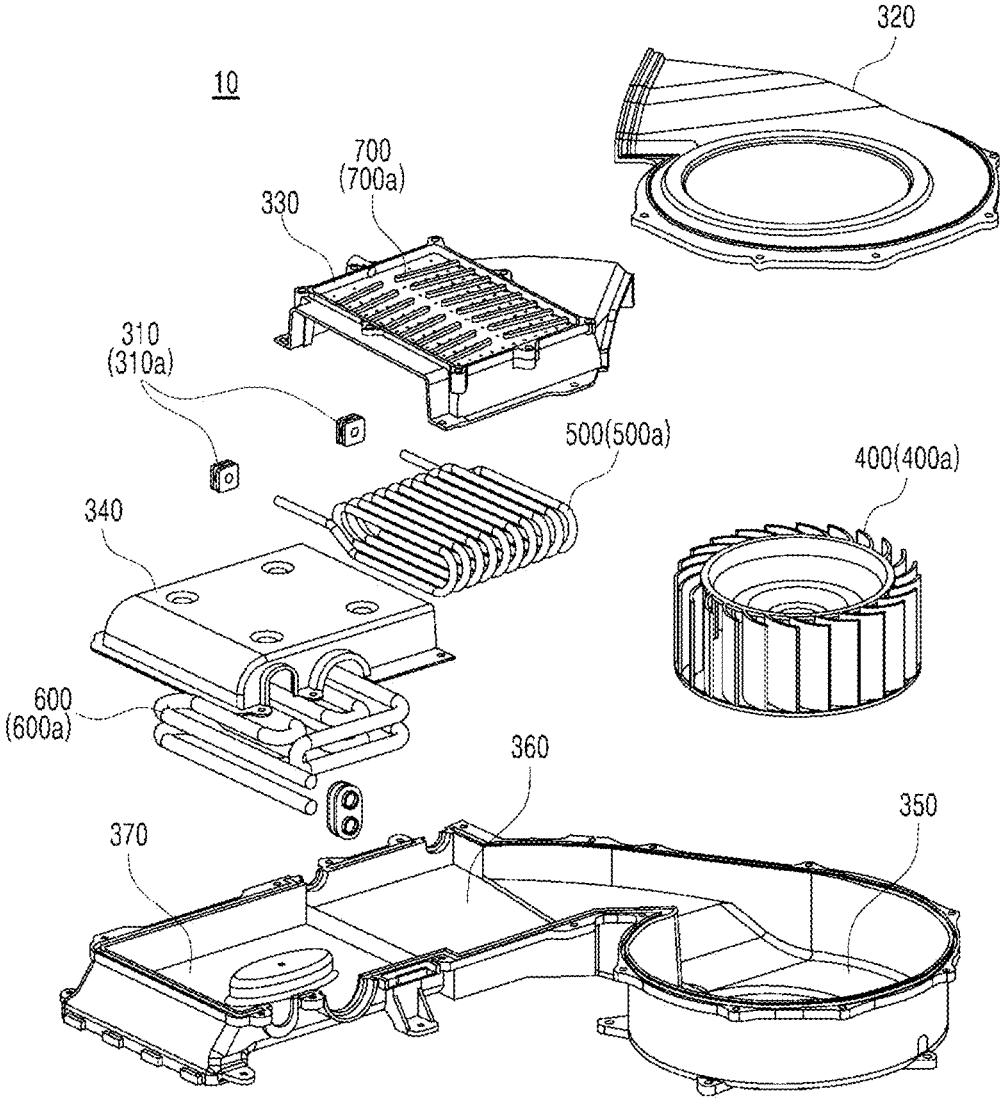
FIG. 4 is an exploded perspective view illustrating an example duct assembly in the laundry treating apparatus.
Figure 5:
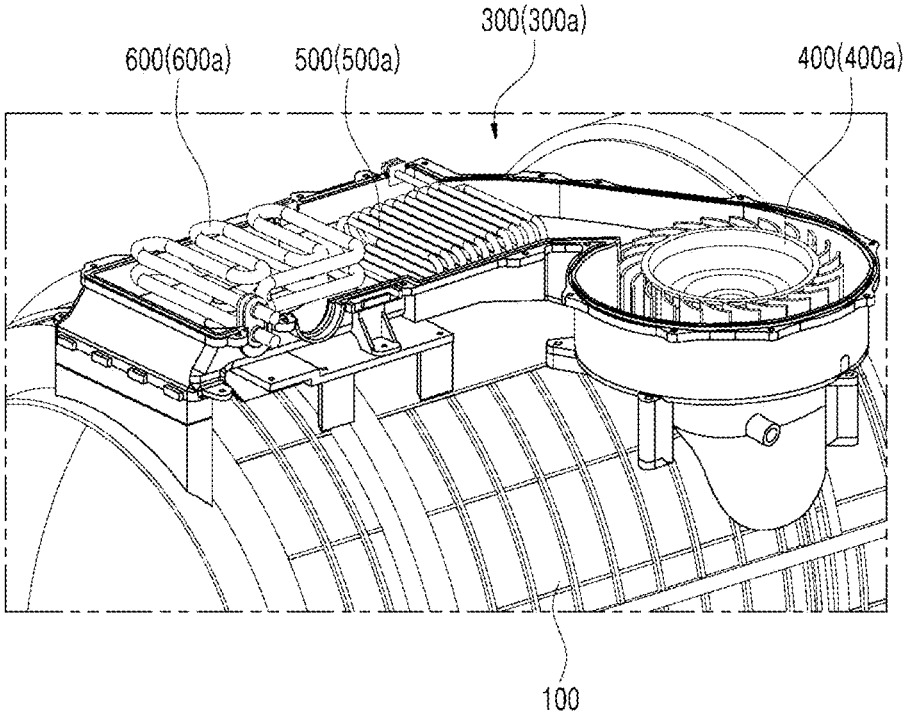
FIGS. 5 and 6 are perspective and plan views illustrating the inside of the duct assembly in the laundry treating apparatus.
Figure 6:
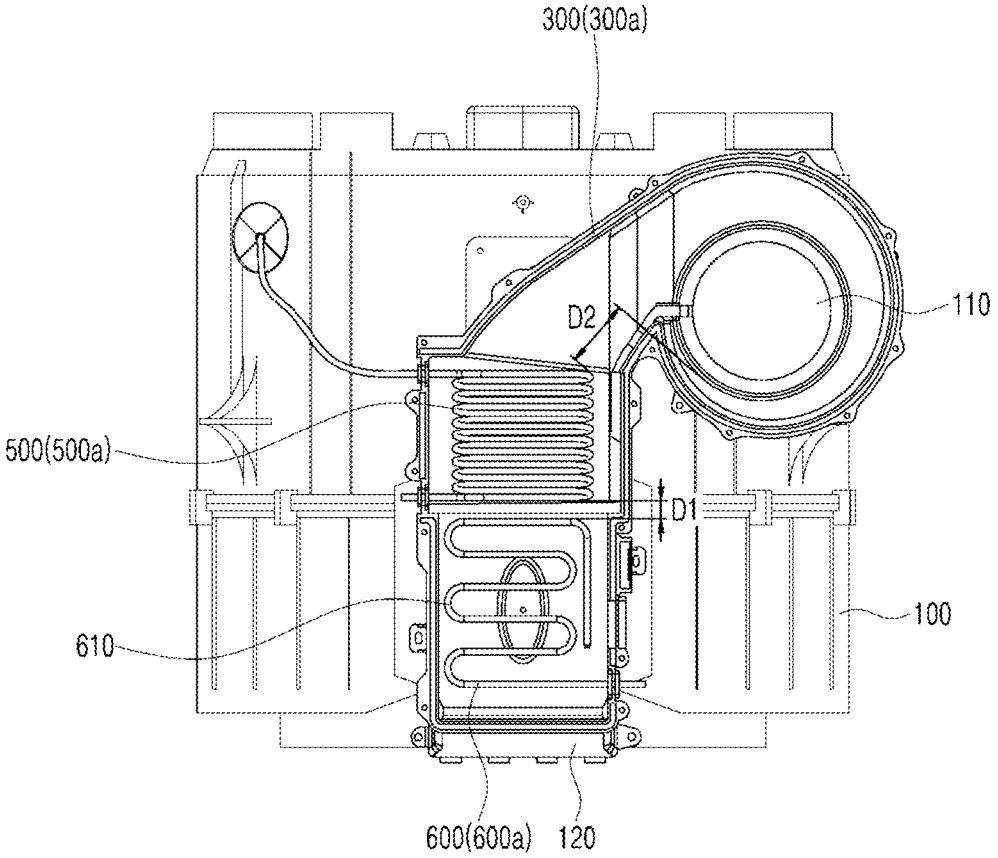

FIG. 3 is a perspective view illustrating a duct assembly installed in the tub in the laundry treating apparatus according to an embodiment of the present disclosure. FIG. 4 is an exploded perspective view of the duct assembly. FIGS. 5 and 6 illustrate the inside of the duct assembly in the laundry treating apparatus.

As illustrated in FIGS. 3 to 6, the laundry treating apparatus 1000 includes a duct assembly 10.

The duct assembly 10 is a part installed on the tub 100 to guide the air discharged from the tub 100 so that the air is re-introduced into the tub 100. The duct assembly 10 includes a circulation flow path part 300, a blower 400, a condenser 500, and a heating part 600.

In order to dry laundry, hot and dry air can be supplied into the drum 200. The hot and dry air introduced into the drum 200 comes into contact with wet laundry accommodated in the drum 200, and takes moisture from the laundry so as to dry the laundry.

In this process, the hot and dry air is changed to a relatively cold and highly humid air state, and the cold and highly humid air is discharged to the outside of the drum 200 through through-holes formed in the wall surface of the drum 200. The cold and highly humid air discharged to the outside of the drum 200 flows between the tub 100 and the drum 200.

For continuously drying the laundry, it is desired to discharge the cold and highly humid air present in the tub 100 and the drum 200, and to re-inject hot and dry air into the tub 100 and the drum 200.

For this purpose, the air can be circulated in the following manner: (i) the air that has been changed to a relatively cold and highly humid state by absorbing moisture is discharged from the tub 100, (ii) moisture is removed from the discharged air, and (iii) the air is heated and then re-supplied into the tub 100.

For the circulation of air as described herein, air may be discharged through a portion of the tub 100, and air may be re-introduced through another portion. That is, the cold and highly humid air present inside the tub 100 is discharged to the outside of the tub 100 through a portion of the tub 100, and is changed to a hot and dry state through a predetermined treatment process in the duct assembly 10, and then re-injected into the inside of the tub 100 through another portion.

The circulation flow path part 300 can be installed on the tub 100 and defines a flow path that allows the air discharged to the outside of the tub 100 to be re-introduced into the tub 100 without being scattered.

In this case, the circulation flow path part 300 may be a duct **300*a* installed on the tub 100 and provided with an air-intake port 110 and an air-inflow port 120 for the flow of air. The circulation flow path part 300** may include various configurations that define a flow path for air circulation, as described herein.

In particular, the duct **300*a* is installed on the upper portion of the tub 100, where it is relatively easy to secure space in the inner space of the cabinet. In order to implement the laundry treating apparatus 1000 in a large capacity, the tub 100 also needs to be enlarged. Thus, in order to install the duct 300*a* on any one of the front, rear, and side surfaces of the tub 100, it is desired to increase the width of the cabinet accordingly. However, since the width or depth of the space in which the laundry treating apparatus 1000 is installed is limited, it may not be desirable to arrange the duct 300*a*** in such a way.

However, provided that there are relatively few restrictions on the height of the space in which the laundry treating apparatus 1000 is installed, it may be desirable to arrange the duct **300*a* on the tub 100** in a way that increases the height of the cabinet.

The blower 400 is a part that is installed in the circulation flow path part 300 and transfers the air discharged from the tub 100 along the circulation flow path part 300, and is configured to transfer the air at a predetermined pressure so that the circulation direction of the air is formed uniformly.

In this case, the blower 400 may be a blower fan **400*a* installed in the duct 300*a* so as to form a flow of air between the air-intake port 110 and the air-inflow port 120**, and may include various components for transferring air for circulation, as described herein.

In particular, the blower fan **400*a* is disposed relatively closer to the air-intake port 110 in the inside of the duct 300*a*, so that the cold and highly humid air in the tub 100 can be more quickly discharged and transferred to the duct 300*a***.

The condenser 500 is installed in the circulation flow path part 300 and is supplied with cooling water so as to condense moisture in the air transferred along the circulation flow path part 300, and changes highly humid air to a dry state by removing the moisture in the air.

In this case, the condenser 500 may be a heat exchanger **500*a* that is installed in the duct 300*a* and is supplied with cooling water to perform heat exchange so as to cool the air transferred along the inside of the duct 300*a***, and may include various components for condensing moisture in the circulated air, as described herein.

In particular, the heat exchanger 500*a* is not installed in a separate space, such as the rear surface of the tub 100, but is installed inside the duct 300*a* together with the blower fan 400*a* and a heater 600*a* to be described herein. Accordingly, it may not be desirable to secure a separate space for moisture condensation in the circulated air.

In addition, in order for the heat exchanger 500*a* to be installed inside the duct 300*a* as described above without problems, the structure of the heat exchanger 500*a* needs to be relatively simplified. If the structure of the heat exchanger 500*a* is complicated, several problems may occur. For example, the heat exchanger 500*a* would be difficult to be disposed inside the duct 300*a*. Further, the duct 300*a* would need to be made relatively large.

Accordingly, in some implementations, the heat exchanger 500*a* has a water-cooled structure that exchanges heat with air using the supplied cooling water. The water-cooled heat exchanger 500*a* may have high heat exchange efficiency compared to an air-cooled type, and may be capable of exchanging heat with a larger capacity of air.

In addition, since heat exchange with the air inside the duct 300*a* can be achieved only by the configuration of supplying cooling water to the heat exchanger 500*a*, moisture can be smoothly removed through a relatively simple structure.

For example, heat exchangers that do not include a water-cooled structure may include separate components for circulating a refrigerant. Therefore, such heat exchangers may have relatively complicating structures.

However, considering the installation environment of the laundry treating apparatus 1000, a water-cooled structure can achieve heat exchange without separate components for circulating the cooling water, because components for supplying washing water have already been provided and can be used for cooling water.

Accordingly, the structure of the heat exchanger 500*a* using the water-cooled structure can be relatively simplified compared to other types of heat exchangers. For example, the water-cooled heat exchanger 500*a* may have an optimized structure in the laundry treating apparatus 1000 capable of easily supplying water.

The air transferred along the inside of the duct 300*a* by the blower fan 400*a* comes into contact with the heat exchanger 500*a* and exchanges heat with the cooling water inside the heat exchanger 500*a*. Accordingly, while the air inside the duct 300*a* is cooled, moisture in the air is condensed. Then, the condensed moisture is condensed on a surface that is in contact with the heat exchanger 500*a*, and then falls.

In this case, in the heat exchanger 500*a*, the cooling water flow path may be a flow path which is closed so as to be separated from the air flow path. That is, since the flow path of the cooling water used in the heat exchanger 500*a* is separated from the flow path for drying air, it is possible to restrict the cooling water from leaking into other parts and coming into contact with the laundry.

Meanwhile, the air from which moisture has been removed by the heat exchanger 500*a* flows towards the air-inflow port 120 along the duct 300*a*.

The heating part 600 is installed in the circulation flow path part 300 so as to heat the air transferred along the circulation flow path part 300, and changes cold air to a hot state by heating the air.

Here, the heating part 600 may be a heater 600*a* that is installed in the duct 300*a* so as to heat the air transferred along the inside of the duct 300*a*, and may include various components for heating the circulated air, as described herein.

The air transferred along the inside of the duct 300*a* by the blower fan 400*a* comes into contact with the heater 600*a*, and the temperature thereof increases. Accordingly, the air inside the duct 300*a* is heated and changed to a hot state. Then, the air that has been changed to the hot state by the heater 600*a* flows towards the air-inflow port 120 along the duct 300*a*.

As described above, the cold and highly humid air discharged from the tub 100 by the blower fan 400*a* and flowing along the duct 300*a* is changed to a relatively hot and highly humid state while passing through the heat exchanger 500*a* and the heating part 600 installed in the duct 300*a*. Then, the air that has been changed to the hot and highly humid state as described above will be re-injected into the tub 100 so as to dry the laundry.

In this way, the laundry treating apparatus 1000 according to this embodiment permits the heat exchanger 500*a* to be installed inside the duct 300*a* in addition to the blower fan 400*a* and the heater 600*a* in such a way that does not need to secure a separate space for condensing moisture in the air. Therefore, it is possible to reduce the restrictions in implementing the laundry treating apparatus 1000 in a large capacity.

In addition, the laundry treating apparatus 1000 according to the present embodiment has a further simplified heat exchange structure by disposing, inside the duct 300*a*, the water-cooled heat exchanger 500*a* configured to exchange heat with air using the supplied cooling water. Thus, moisture can be removed smoothly while also reducing the number of components for moisture condensation in the air.

In particular, compared to the heat pump-type heat exchanger, the water-cooled heat exchanger 500*a* in the laundry treating apparatus 1000 according to the present embodiment may be more economical and easier to arrange in a limited space within the duct 300*a*.

In the laundry treating apparatus 1000 according to an embodiment of the present disclosure, the condenser 500 may be disposed between the blower 400 and the heating part 600. That is, the heat exchanger 500*a* may be disposed between the blower fan 400*a* and the heater 600*a*.

In this case, the flow of air may be formed in a direction from the air-intake port 110 towards the air-inflow port 120 via the heat exchanger 500*a* and the heater 600*a* sequentially.

When the cold and highly humid air in the duct 300*a* is changed to a relatively hot and dry state through the above-described process, it is preferable for the air discharged from the tub 100 to first come into contact with the heat exchanger 500*a* and then come into contact with the heater 600*a*.

In this case, the cold and highly humid air discharged from the tub 100 first comes into contact with the heat exchanger 500*a*, and moisture is removed therefrom such that the air is turned into cold and dry air. Thereafter, the cold and dry air may come into contact with the heater 600*a* so as to be turned into hot and dry air.

By contrast, when the cold and highly humid air discharged from the tub 100 first comes into contact with the heater 600*a*, the air is heated and turned into relatively hot and highly humid air. Thereafter, when the hot and highly humid air comes into contact with the heat exchanger 500*a*, moisture in the air may be removed, but the air is cooled by the heat exchanger 500*a* and turned into a cold state.

That is, if the air discharged from the tub 100 first comes into contact with the heater 600*a* and then comes into contact with the heat exchanger 500*a*, the heated air would be cooled again. Thus, drying efficiency would be deteriorated.

Therefore, it is preferable to arrange the heat exchanger 500*a* between the blower fan 400*a* and the heater 600*a* in the duct 300*a* such that the air discharged from the tub 100 first comes into contact with the heat exchanger 500*a* and then comes into contact with the heater 600*a*.

As described above, in the laundry treating apparatus 1000 according to the present embodiment, moisture is first removed by the heat exchanger 500*a* from the air transferred along the inside of the duct 300*a* through the blower fan 400*a*, and then the air is heated by the heater 600*a*. Therefore, drying efficiency for laundry can be further improved by preventing a situation where the heated air is cooled again.

In the laundry treating apparatus 1000 according to an embodiment of the present disclosure, the condenser 500 may be disposed to be spaced apart from the heating part 600 so as not to come into contact with the heating part 600. That is, the heat exchanger 500*a* may be disposed to be spaced apart from the heater 600*a* so as not to come into contact with the heater 600*a*.

As described above, if the heat exchanger 500*a* is disposed between the blower fan 400*a* and the heater 600*a*, there would potentially be an influence due to a difference in temperature between the heat exchanger 500*a* and the heater 600*a*. In particular, if the heat emitted from the heater 600*a* in a relatively hot state affects the heat exchanger 500*a* in a relatively cold state, the temperatures of the surface of the cooling water and the heat exchanger 500*a* would be increased, so cooling of the air would not be smoothly performed.

Therefore, it is preferable for the heat exchanger 500*a* and the heater 600*a*, which are disposed adjacent to each other, to be spaced apart from each other while maintaining a minimum distance therebetween that restricts the functions thereof from being affected by each other.

In this case, if desirable, a heat insulating material or the like for blocking heat transfer may be disposed between the heat exchanger 500*a* and the heater 600*a*, and such a heat insulating material may be provided with a plurality of ventilation holes so as not to interfere with the movement of air inside the duct 300*a*.

In this way, in the laundry treating apparatus 1000 according to the present embodiment, the heat exchanger 500*a* and the heater 600*a* are spaced apart from each other such that the heat emitted from the heater 600*a* does not affect the function of the heat exchanger 500*a*. Therefore, it is possible to secure the reliability of the heat exchanger 500*a*, which would otherwise be deteriorated due to an increase in temperature of the heat exchanger 500*a* itself.

Meanwhile, as described above, when the heat exchanger 500*a* is disposed between the blower fan 400*a* and the heater 600*a*, damage to the blower fan 400*a* may be restricted.

If the blower fan 400*a* and the heater 600*a* are disposed adjacent to each other without being spaced apart from each other, the heat emitted from the heater 600*a* would cause damage, such as melting or deformation of the injection-molded products of the blower fan 400*a*.

In addition, the motor for operating the blower fan 400*a* would also potentially overheat due to the heat emitted from the heater 600*a*, and the function of the motor would be deteriorated.

Therefore, in the laundry treating apparatus 1000 according to the present embodiment, the blower fan 400*a* and the heater 600*a* are spaced apart from each other, and the heat exchanger 500*a* is disposed in this separation space, and thus heat emitted from the heater 600*a* does not damage the injection-molded products of the blower fan 400*a*, the motor, and the like. Therefore, it is possible to restrict disruption in air circulation due to the deterioration of the function of the blower fan 400*a*.

Figure 26:
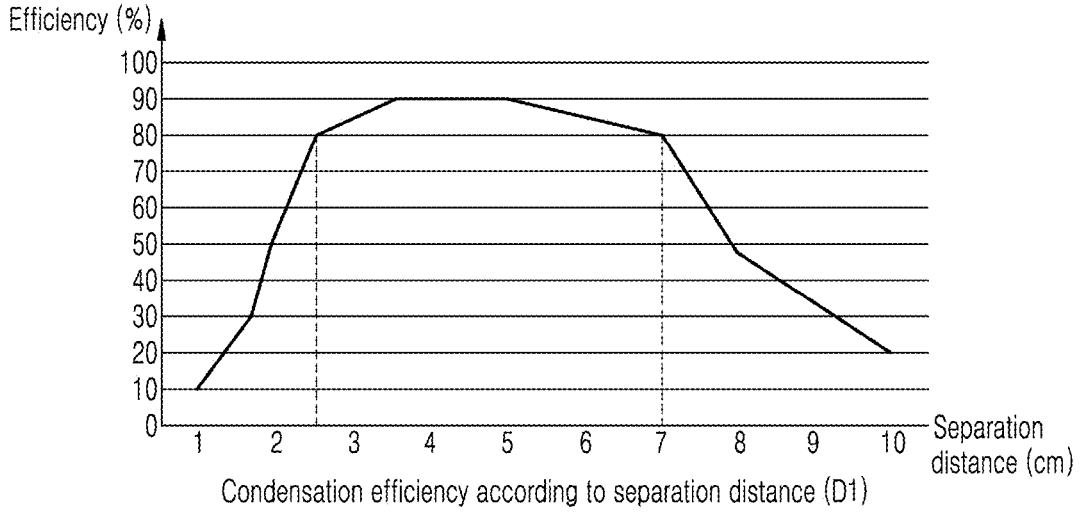
FIG. 26 illustrates example condensation efficiency according to a separation space between a heat exchanger and a heater in the laundry treating apparatus.

FIG. 26 illustrates condensation efficiency according to a separation space between a heat exchanger and a heater in the laundry treating apparatus according to an embodiment of the present disclosure.

In the laundry treating apparatus 1000 according to an embodiment of the present disclosure, the heat exchanger 500*a* may be arranged to have a separation distance D1 in the range of 2.5 cm or more and 7 cm or less from the heater 600*a*.

Specifically, with reference to FIG. 26, the separation distance D1 between the heat exchanger 500*a* and the heater 600*a* will be described below.

First, it is desirable to secure at least 2.5 cm as the separation distance D1 between the heat exchanger 500*a* and the heater 600*a*. The separation distance D1 of 2.5 cm is a limit value at which the heat emitted from the heater 600*a* does not affect the performance of the heat exchanger 500*a*.

When the separation distance D1 is less than 2.5 cm, the efficiency of condensation of moisture in the air through the heat exchanger 500*a* is reduced to about 80% or less. Thus, the heat exchange with the air through the heat exchanger 500*a* may not be performed smoothly.

In particular, as illustrated in FIG. 26, when the separation distance D1 is less than 2.5 cm, compared to the case where the separation distance D1 is 2.5 cm or more, the efficiency of condensation of moisture in the air through the heat exchanger 500*a* is critically sharply lowered. Thus, it is preferable to maintain the separation distance D1 between the heat exchanger 500*a* and the heater 600*a* at 2.5 cm or more.

Meanwhile, as the separation distance D1 between the heat exchanger 500*a* and the heater 600*a* increases, the performance of the heat exchanger 500*a* can be further restricted from being degraded by the heater 600*a*. Further, the effect on the efficiency of condensation of moisture in the air through the heat exchanger 500*a* is not large.

However, when the separation distance D1 between the heat exchanger 500*a* and the heater 600*a* exceeds 7 cm, the air that has passed through the heat exchanger 500*a* may be excessively cooled before reaching the heater 600*a*, and thus may not be sufficiently heated by the heater 600*a*.

In particular, as illustrated in FIG. 26, when the separation distance D1 exceeds 7 cm, compared to the case where the separation distance D1 is 7 cm or less, the efficiency of condensation of moisture in the air through the heat exchanger 500*a* is critically sharply lowered. Thus, it is preferable to maintain the separation distance D1 between the heat exchanger 500*a* and the heater 600*a* at 7 cm or less.

Therefore, in order to ensure that the efficiency of condensation of moisture in the air is improved and the heating of the air is smoothly performed, it may be preferable to maintain the separation distance D1 between the heat exchanger 500*a* and the heater 600*a* in the range of 2.5 cm or more and 7 cm or less.

Meanwhile, in the laundry treating apparatus 1000 according to an embodiment of the present disclosure, the separation distance D1 between the heat exchanger 500*a* and the heater 600*a* may be relatively smaller than the separation distance D2 between the blower fan 400*a* and the heat exchanger 500*a*.

That is, as illustrated in FIG. 6, when the blower fan 400*a*, the heat exchanger 500*a*, and the heater 600*a* are disposed inside the duct 300*a*, the heat exchanger 500*a* may be disposed closer to the heater 600*a* than the blower fan 400*a*.

Naturally, even in this case, it is preferable to maintain the above-mentioned minimum limit value of the separation distance D1 between the heat exchanger 500*a* and the heater 600*a*.

Even if a distance that the air passing through the blower fan 400*a* travels until reaching the heat exchanger 500*a* varies, the change in the state of the air may not be significant. In contrast, as described above, when the moving distance of the air passing through the heat exchanger 500*a* until reaching the heater 600*a* is increased, the air cooled while passing through the heat exchanger 500*a* may not be sufficiently heated by the heater 600*a*.

Therefore, on the movement path of the air, it is preferable to set the separation distance D1 between the heat exchanger 500*a* and the heater 600*a* to be smaller than the separation distance D2 between the blower fan 400*a* and the heat exchanger 500*a*, within the range in which the minimum limit value is maintained.

In the laundry treating apparatus 1000 according to an embodiment of the present disclosure, some of the washing water used in the tub 100 may be supplied to the condenser 500 to be used as cooling water. That is, some of the washing water may be supplied to the heat exchanger 500*a* and may be used as cooling water.

The tub 100 is provided with a water supply hose for supplying washing water. The water supply hose may supply washing water into the tub 100 through a separately installed detergent box or the like.

The water supply hose connected to the tub 100 may be connected to the front or outer circumferential surface of the tub 100. In addition, the water supply hose may be branched and connected to each of the front and outer circumferential surfaces of the tub 100. When the water supply hose is branched and connected, each branch hose may additionally include a valve for blocking the flow path of washing water.

Accordingly, even if a separate cooling water supply apparatus is not installed to supply cooling water to the heat exchanger 500*a*, some of the washing water may be supplied to the heat exchanger 500*a* and may be used as cooling water. To this end, a branch hose may be connected from the water supply hose to the heat exchanger 500*a* so that some of the washing water is supplied to the heat exchanger 500*a*.

In this way, in the laundry treating apparatus 1000 according to the present embodiment, some of the washing water is used as cooling water without a separate component for supplying cooling water to the heat exchanger 500*a*. Thus, it is possible to further simplify the structure of the heat exchanger 500*a*, such that the degree of freedom of arrangement of the heat exchanger 500*a* can be improved.

Figure 7:
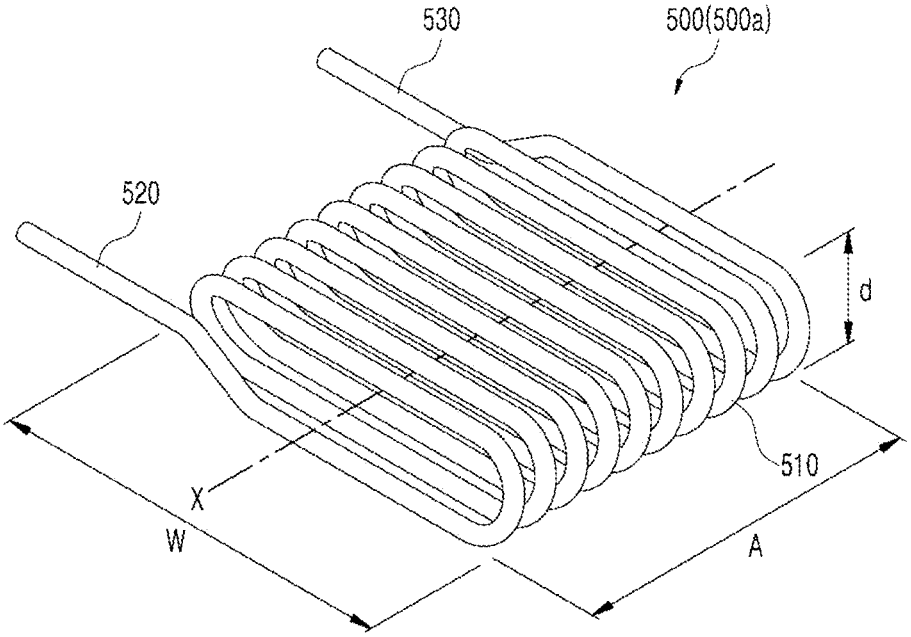
FIGS. 7 to 9 are perspective, front, and side views illustrating an example condenser in the laundry treating apparatus.
Figure 8:
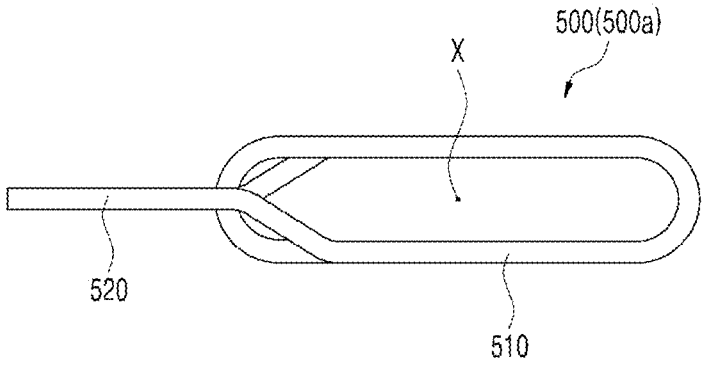
Figure 9:
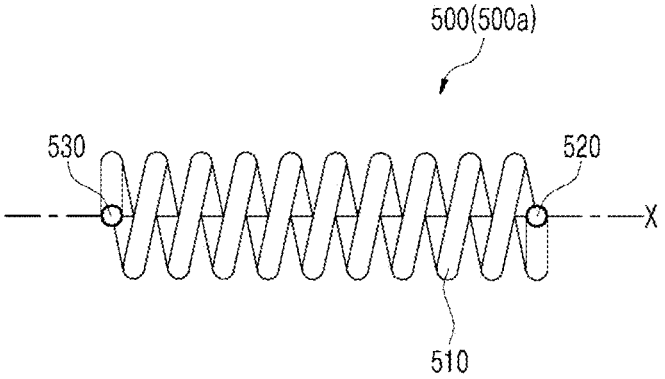
Figure 10:
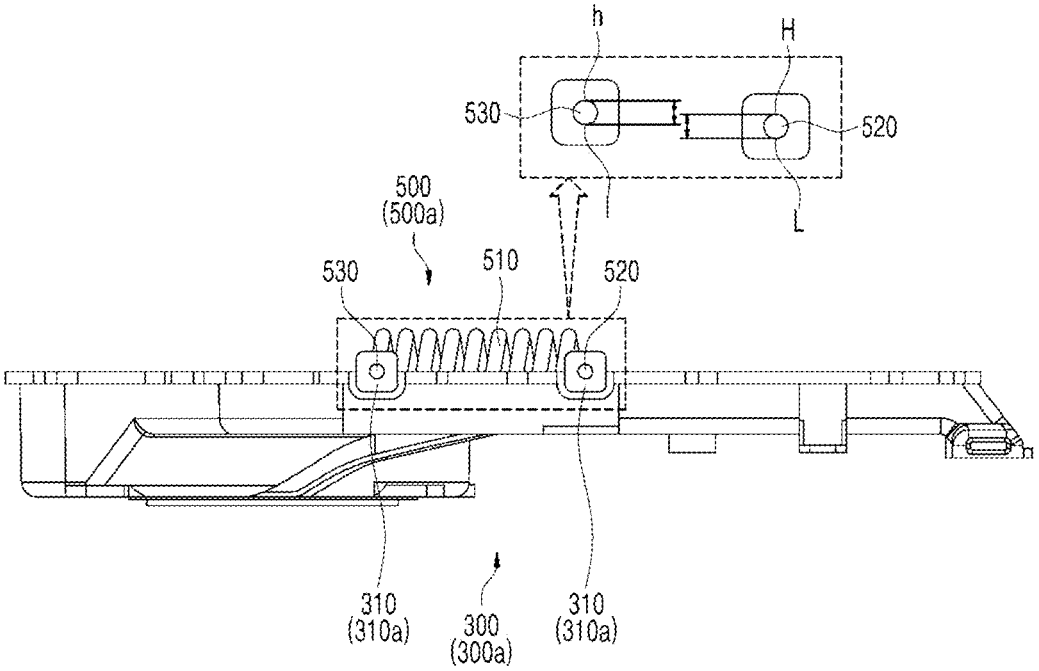
FIG. 10 is a view illustrating that a condenser is installed in a circulation flow path part in the laundry treating apparatus.

FIGS. 7 to 9 illustrate a condenser in the laundry treating apparatus according to an embodiment of the present disclosure. FIG. 10 illustrates the state in which a condenser is installed in a circulation flow path part in the laundry treating apparatus according to an embodiment of the present disclosure.

As illustrated in FIGS. 7 to 10, in the laundry treating apparatus 1000 according to an embodiment of the present disclosure, the condenser 500 may be configured in a loop coil shape so as to have a pipe structure that allows cooling water to pass therein. That is, the heat exchanger 500*a* may include a pipe 510 formed in a loop coil shape through which cooling water can pass.

In this case, the loop coil shape means a coil shape that is repeatedly wound in an annular shape around a central axis X. The loop coil shape may be configured in a spiral structure in which a lower pipe portion and an upper pipe portion spaced upward from the lower pipe portion repeatedly reciprocate.

With the pipe 510 having such a structure, it is possible to secure a larger surface area required for heat exchange in a limited space. Thus, the air moving through the spaces between the turns of the helical structure of the pipe 510 may exchange heat on the surface of the pipe 510 with the cooling water inside the pipe 510.

As described above, in the laundry treating apparatus 1000 according to the present embodiment, cooling water flows into the pipe 510 of the loop coil shape and heat is exchanged with the air outside the pipe 510. Thus, it is possible to improve heat exchange efficiency relative to the area occupied by the heat exchanger 500*a* inside the duct 300*a*.

Figure 35:
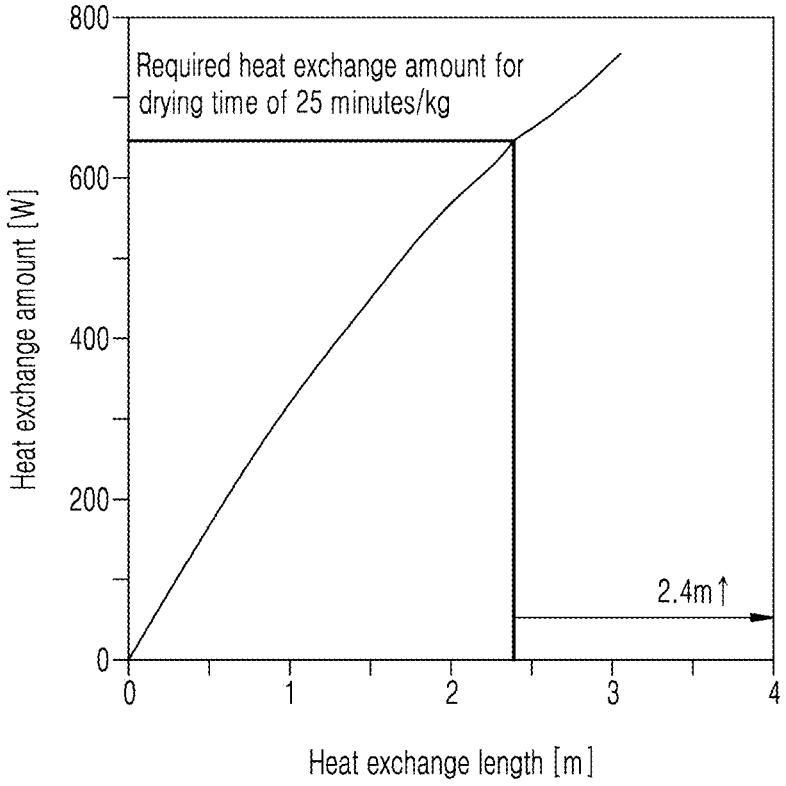
FIG. 35 is an example diagram illustrating a required heat exchange amount and heat exchange length of the laundry treating apparatus.

FIG. 35 is a diagram illustrating a required heat exchange amount and heat exchange length of the laundry treating apparatus according to an embodiment of the present disclosure.

As shown in FIG. 35, as a result of experimentation, a heat exchange amount of approximately 650 W is required in order to keep the drying time within 25 minutes/kg, and the required heat exchange length according thereto may be 2.4 m or more.

However, if the heat exchange length is excessively long, more so than is necessary, overcooling would occur, and the drying efficiency of the laundry would thereby be decreased.

Accordingly, it may be preferable to set the required heat exchange length to between 2.4 m and 3 m.

In addition, in order for the heat exchanger 500*a* with the heat exchange length as described above to be effectively disposed inside the duct 300*a*, it is preferable for the heat exchanger 500*a* to be formed of a pipe 510 having the shape of a loop coil.

In this case, a three-stage loop coil structure in which an intermediate pipe portion is additionally present, between a lower pipe portion and an upper pipe portion, may be considered.

However, since the three-stage loop coil structure has a difference in condensation performance of only approximately 3% compared to the two-stage loop coil structure shown in FIG. 7, the condensation performances thereof can be said to be substantially equivalent.

Further, the three-stage loop coil structure may has shortcomings in that the open area on the movement path of the air is reduced, such that more lint may become attached to the heat exchanger 500*a* and the amount of air may be reduced.

Accordingly, in consideration of the above, it is preferable for the heat exchanger 500*a* to have a two-stage loop coil structure.

Meanwhile, in the pipe 510 having the shape of a loop coil shown in FIG. 7, it is preferable that a length W in the direction intersecting the central axis X is relatively larger than a length A in the direction parallel to the central axis X.

That is, it is preferable for the pipe 510 to be designed in the shape of a loop coil such that $W/A>1$.

As described above, when the heat exchange length is set to between 2.4 m and 3 m, as the length of A increases, the length of W decreases. In this case, if A becomes excessively large, overcooling may occur in the same way as in the case of an excessive overall heat exchange length, and there is thus a possibility of the drying efficiency of the laundry being reduced.

Accordingly, it may be preferable for the length of A to be made relatively smaller than the length of W.

In the laundry treating apparatus 1000 according to an embodiment of the present disclosure, the pipe 510 may be made of a material containing at least one of stainless steel, a copper alloy, an aluminum alloy, or a nickel alloy.

In this case, the stainless steel is a steel alloy made to withstand corrosion well, and is a material made of an alloy of iron, nickel, chromium, and the like. The copper alloy is a material made of an alloy of copper, tin, zinc, aluminum, and the like. The aluminum alloy is a material made of an alloy of aluminum, copper, magnesium, and the like. The nickel alloy is a material made of an alloy of nickel, copper, chromium, molybdenum, iron, and the like.

As described above, the moisture condensed by the heat exchanger 500*a* is condensed on the surface that is in contact with the heat exchanger 500*a*. Accordingly, the surface of the pipe 510 in direct contact with the circulating air is exposed to moisture for a long time.

In this case, if corrosion occurs in the heat exchanger 500*a* disposed in the duct 300*a*, contaminants would be introduced into the tub 100 via the circulating air, and these contaminants would contaminate the laundry.

Therefore, the pipe 510 is preferably made of a material containing at least one of stainless steel, a copper alloy, an aluminum alloy, or a nickel alloy, which are relatively less prone to corrosion so as to avoid sanitation problems due to contamination even if the pipe 510 is exposed to moisture for a long time.

As described above, in the laundry treating apparatus 1000 according to the present embodiment, cooling water flows into the pipe 510 made of a corrosion-resistant material and heat is exchanged with the air outside the pipe 510. Thus, it is possible to restrict occurrence of sanitation problems in the laundry treating apparatus 1000 due to corrosion or the like of the heat exchanger 500*a*.

When the pipe 510 is made of a material containing aluminum (Al), a phenomenon in which the surface of the pipe 510 peels may occur. This phenomenon occurs when the aluminum (Al) surface is exposed to oxygen ($O_2$) and becomes aluminum oxide ($Al_2O_3$).

That is, the volume of the aluminum (Al) surface expands in the process of the aluminum (Al) surface being oxidized, and stress generated in this process causes the surface to peel. In addition, this peeling phenomenon may cause deterioration of the durability of members, as well as deterioration of usability from the point of view of a user.

Accordingly, the pipe 510 made of a material containing aluminum (Al) needs to be treated so as to restrict peeling from occurring.

To this end, a method for restricting oxidation of the aluminum (Al) surface, by for example coating the surface of the pipe 510, may be considered.

Alternatively, a method for reducing peeling by forming a solid oxide film by anodizing the surface of the pipe 510 may be considered.

In the laundry treating apparatus 1000 according to an embodiment of the present disclosure, the condenser 500 may be configured such that cooling water flows into one end thereof disposed relatively closer to the air-inflow port 120 side, and is discharged from the other end thereof disposed relatively closer to the air-intake port 110 side.

That is, the heat exchanger 500*a* may further include a water supply port 520 disposed relatively closer to the air-inflow port 120 side in a plan view and configured to cause cooling water to flow into the pipe 510, and a drain port 530 disposed relatively closer to the air-intake port 110 in a plan view and configured to cause the cooling water to be discharged from the pipe 510.

In general, a counter flow, in which a hot fluid and a cold fluid enter opposite sides of the heat exchanger 500*a* and flow in opposite directions, may make it possible to cool the air flow path up to the rearmost point with the coldest cooling water.

Accordingly, compared to a parallel flow, in which a hot fluid and a cold fluid enter the same side of the heat exchanger 500*a* and flow in the same direction, such a counter flow has higher heat exchange efficiency.

In this regard, when the water supply port 520 and the drain port 530 are disposed as described above, the air flow direction and the cooling water flow direction in the duct 300*a* are opposite to each other, so that a counter flow can be achieved.

In addition, in the laundry treating apparatus 1000 according to an embodiment, the portion of the heat exchanger 500*a* into which cooling water is introduced is disposed behind the portion of the heat exchanger 500*a* from which coolant is discharged with respect to the air movement path inside the duct 300*a*. Thus, it is possible to increase the efficiency of the heat exchanger by cooling the air flow path up to the rearmost portion using the lowest temperature coolant.

In the laundry treating apparatus 1000 according to an embodiment of the present disclosure, the duct assembly 10 may further include sealing parts 310 interposed in portions at which each of one end and the other end of the condenser 500 are exposed to the outside of the circulation flow path.

That is, the duct 300*a* may include gaskets 310*a* installed on a side surface of a portion of the duct 300*a* at which the heat exchanger 500*a* is disposed, and the gaskets 310*a* may be penetrated by the water supply port 520 and the drain port 530, respectively.

In this case, the sealing parts 310 may be gaskets 310*a*, and may include various components for maintaining airtightness with respect to the remaining parts other than the water supply port 520 for supplying cooling water and the drain port 530.

As described above, in order to condense moisture using the cooling water supplied to the heat exchanger 500*a*, it is desirable to discharge the cooling water that has undergone heat exchange and to supply new cold cooling water.

To this end, the cooling water needs to be circulated around the heat exchanger 500*a*, and it may be difficult to arrange all the components for the circulation of the cooling water in the duct 300*a*.

In particular, if some of the washing water is used as cooling water, it would be difficult to dispose a water supply hose or the like inside the duct 300*a*. Thus, the water supply port 520 and the drain port 530 of the heat exchanger 500*a* are desired to be exposed to the outside of the duct 300*a*.

Meanwhile, in order for the drying function for laundry to be smoothly performed, it is desirable to reduce the scattering of air circulated along the duct 300*a* to the outside of the duct 300*a* or the introduction of the air outside the duct 300*a* into the duct 300*a*.

Accordingly, when exposing the water supply port 520 and the drain port 530 to the outside of the duct 300*a* for the circulation of cooling water, ensuring airtightness of the corresponding portions may improve the efficiency of drying laundry.

Therefore, it is preferable to dispose the gaskets 310*a*, which are respectively penetrated by the water supply port 520 and the drain port 530, on one side surface of the duct 300*a*, so as to secure airtightness for the corresponding portions.

As described above, in the laundry treating apparatus 1000 according to the present embodiment, the portion of the heat exchanger 500*a* exposed to the outside of the duct 300*a* is supported by the gaskets 310*a* disposed on a portion of the duct 300*a*. Thus, cooling water can be smoothly circulated while maintaining airtightness between the inside and outside of the duct 300*a*.

In the laundry treating apparatus 1000 according to an embodiment of the present disclosure, any one of the uppermost end H and the lowermost end L of the water supply port 520 may be located at a height between the uppermost end h and the lowermost end 1 of the drain port 530.

In the case of assembling the duct assembly 10 having the above-described configuration, the duct 300*a* may be manufactured by combining several members that are separated from each other.

For example, it is possible to assemble the duct assembly 10 by mounting the blower fan 400*a*, the heat exchanger 500*a*, and the heater 600*a* on a base member constituting the bottom and the lower side surface of the duct 300*a*, and then covering the upper portions thereof with a cover member constituting the top surface and the side surface of the duct 300*a*.

In this case, if the water supply port 520 and the drain port 530 are located at different heights, the side surfaces of the base member and the cover member would have to be configured to reflect this.

In contrast, as illustrated in FIG. 10, when the water supply port 520 and the drain port 530 are located at the same height as each other, it is possible to assemble the gaskets 310*a* on respective coupling surfaces of the base member and the cover member, such that each member can be more easily assembled.

However, in some implementations, it may be difficult to dispose the water supply port 520 and the drain port 530 at the physically same height in consideration of manufacturing and installation errors.

Therefore, even if the water supply port 520 and the drain port 530 are located at heights different from each other to a certain extent, it is desirable to limit the height difference between the water supply port 520 and the drain port 530 to a range that does not significantly reduce the ease of assembly, as described herein.

To this end, as illustrated in FIG. 10, the heat exchanger 500*a* may be installed in the duct 300*a* such that any one of the uppermost end H and the lowermost end L of the water supply port 520 is located at a height between the uppermost end h and the lowermost end 1 of the drain port 530.

As described above, in the laundry treating apparatus 1000 according to the present embodiment, when multiple portions of the heat exchanger 500*a* are exposed to the outside of the duct 300*a*, the corresponding portions are disposed at the same or partially overlapping heights. Thus, it may be easier to assemble the heat exchanger 500*a* and the duct 300*a*.

In the laundry treating apparatus 1000 according to an embodiment of the present disclosure, the water supply port 520 and the drain port 530 may be disposed in the same direction with respect to the pipe 510. For example, as illustrated in FIG. 10, the water supply port 520 and the drain port 530 may penetrate one side surface of the duct 300*a* together.

When the water supply port 520 and the drain port 530 are arranged as described above, since the hoses and the like that are connected to the water supply port 520 and the drain port 530 can be arranged only in one direction, it is possible to reduce the length thereof.

In addition, it may be easier to manufacture the heat exchanger 500*a* including the pipe 510, the water supply port 520 and the drain port 530, and it may also be easier to install the heat exchanger 500*a* to the duct 300*a*.

Meanwhile, the duct 300*a* may be provided with a cleaning water inflow port 331 for introducing cleaning water into the cleaning nozzle 700*a*, and the cleaning water inflow port 331 may be arranged in the same direction as at least one of the water supply port 520 or the drain port 530.

Accordingly, as described above, the arrangement of pipes such as branch pipes may be efficient, and the heat exchanger 500*a* may be more easily installed to the duct 300*a*.

In the laundry treating apparatus 1000 according to an embodiment of the present disclosure, the pipe 510 may have the central axis X of a spiral shape in the air flow direction.

That is, when viewed in the air flow direction, the pipe 510 may be disposed in the shape illustrated in FIG. 8. Accordingly, the pipe 510 may be disposed such that a projection surface in the air flow direction has an annular shape.

With respect to the pipe 510 arranged in this way, the air discharged from the tub 100 passes through the spaces between the turns of the pipe 510 of the spiral structure that reciprocate repeatedly. Accordingly, since a relatively large open area is secured on the air flow path, the amount of air passing through the inside of the duct 300*a* may be increased.

In contrast, when the pipe 510 is disposed in the shape illustrated in FIG. 9 when viewed in the air flow direction, the open area is reduced compared to the above case, and thus the amount of air passing through the inside of the duct 300*a* may be reduced.

Meanwhile, with respect to the heat exchanger 500*a* arranged as described above, the arrangement direction of the heater 600*a* may also be arranged parallel to the heat exchanger 500*a* to a certain extent. That is, the heater 600*a* may include a radiator 610 extending in a zigzag shape in the air flow direction.

Specifically, as illustrated in FIG. 6, the radiator 610 may include a plurality of straight pipes and curved pipes connecting adjacent respective straight pipes to each other. In this case, each straight tube is arranged in a direction in which the longitudinal direction thereof intersects the air flow direction.

Accordingly, the straight pipes of the radiator 610 are spaced apart from each other at predetermined intervals in the air flow direction and arranged parallel to each other, and curved pipes are coupled to the ends of respective straight pipes.

Accordingly, the radiator 610 may have a zigzag shape as a whole, and may extend in the air flow direction.

The radiator 610 described above may also have a pipe structure through which a hot fluid passes. Considering the volume of air passing through the inside of the duct 300*a* and the contact surface between the air and the radiator 610, it is preferable to arrange the radiator 610 in the direction illustrated in FIG. 6.

Figure 11:
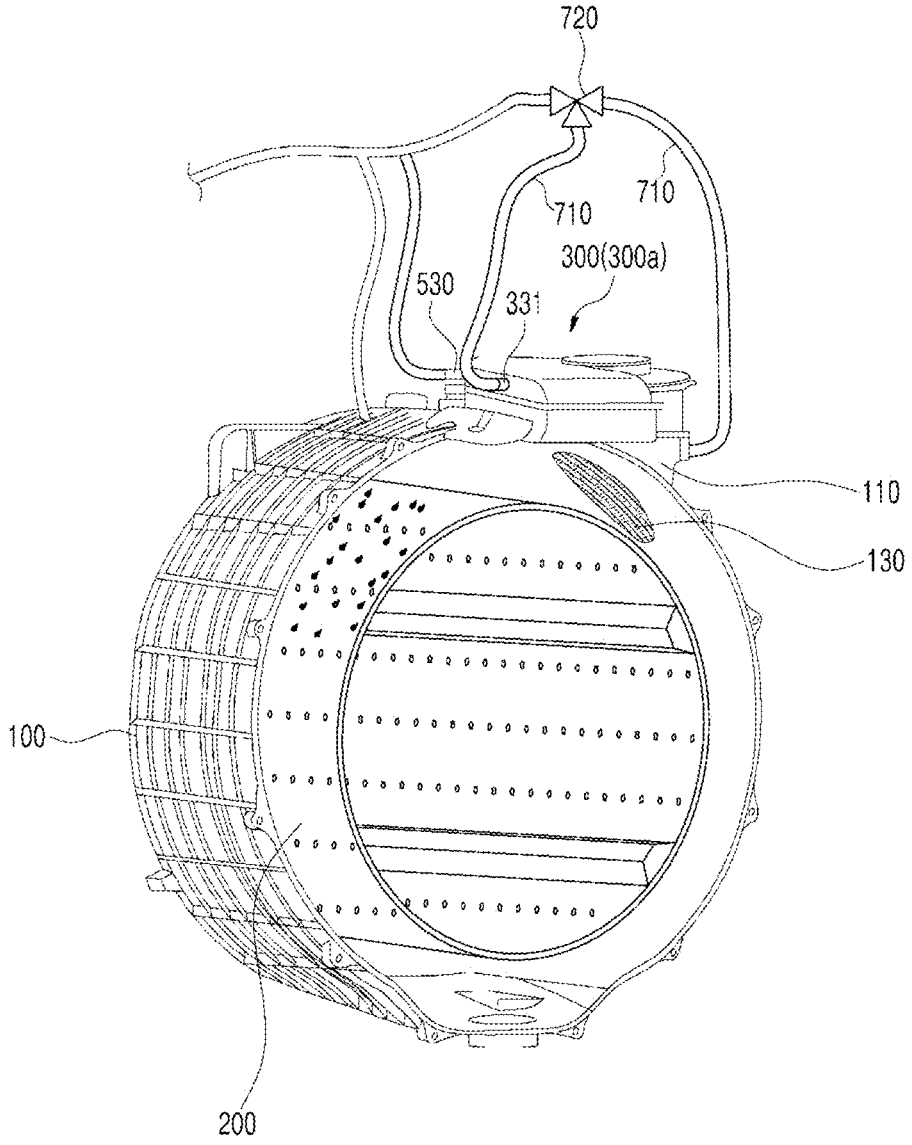
FIG. 11 is a view illustrating the inside of an example tub in the laundry treating apparatus.
Figure 12:
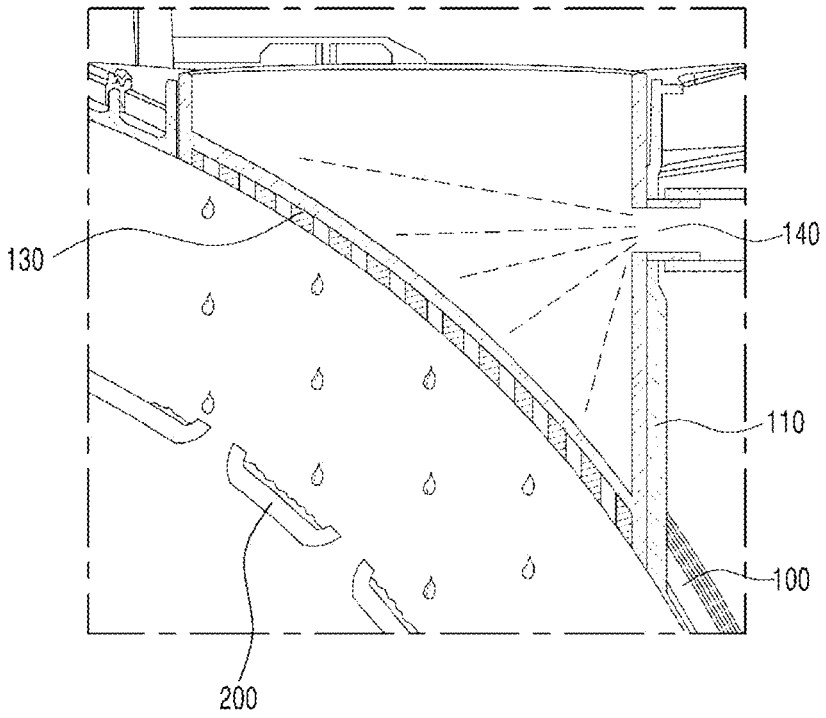
FIG. 12 is a view illustrating an example filter cleaner in the laundry treating apparatus.
Figure 30:
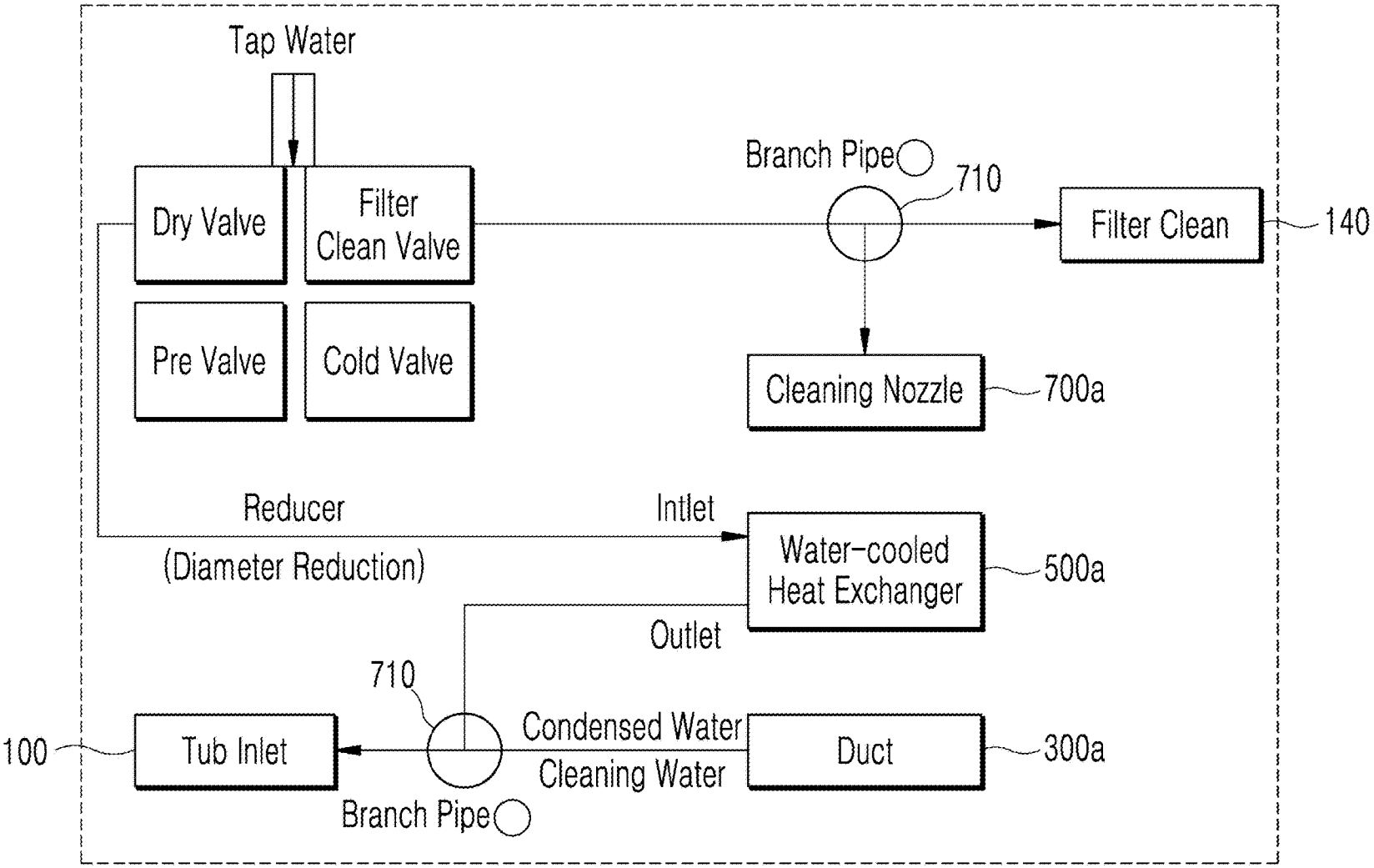
FIG. 30 schematically illustrates paths for supplying and discharging cooling water, cleaning water, and condensed water in a laundry treating apparatus according to an embodiment of the present disclosure.

FIG. 11 illustrates the inside of a tub in the laundry treating apparatus according to an embodiment of the present disclosure. FIG. 12 illustrates a filter cleaner in the laundry treating apparatus according to an embodiment of the present disclosure. FIG. 30 schematically illustrates paths for supplying and discharging cooling water, cleaning water, and condensed water in a laundry treating apparatus according to an embodiment of the present disclosure.

In the laundry treating apparatus 1000 according to an embodiment of the present disclosure, the other end of the condenser 500 is connected to the tub 100, and the cooling water discharged from the condenser 500 may be injected into the tub 100.

That is, the drain port 530 may be connected to the tub 100, and the cooling water discharged from the drain port 530 may be injected into the tub 100.

As described above, in the heat exchanger 500*a*, it is desirable to discharge the heat-exchanged cooling water and to receive new cold cooling water. In some implementations, a separate component may be used for discharging the heat exchanged cooling water from the heat exchanger 500*a* and then processing the cooling water.

In other implementations, it is possible to use a discharge structure disposed in the tub 100, by guiding the cooling water discharged from the heat exchanger 500*a* to the tub 100 rather than to such a separate component.

That is, since the tub 100 has a separate discharge structure for discharging the used washing water after washing laundry or water after dehydration, when cooling water is guided to the tub 100, the cooling water can be discharged through the discharge structure of the tub 100 together with the washing water.

Alternatively, in some cases, the cooling water guided into the tub 100 may flow along the outer circumferential surface of the drum 200 and may be stored in the tub 100 so as to serve as washing water for washing laundry.

As described above, in the laundry treating apparatus 1000 according to the present embodiment, the cooling water discharged from the heat exchanger 500*a* is treated by injecting the cooling water into the tub 100 without a separate discharge structure. Thus, it is possible simplify the structure of the heat exchanger 500*a*, such that the degree of freedom of arrangement of the heat exchanger 500*a* can be improved.

In the laundry treating apparatus 1000 according to an embodiment of the present disclosure, due to the cooling water injected into the tub 100, the surface of the drum 200 may act as a condensation surface.

That is, as illustrated in FIG. 11, the cooling water injected into the tub 100 may fall to the outer circumferential surface of the drum 200. In this way, the cooling water that falls to the outer circumferential surface of the drum 200 may lower the temperature of the drum 200, such that the drum 200 is capable of functioning as a condensing plate.

In this case, it is preferable to restrict the cooling water from flowing into the inside of the drum 200 (i.e., the space in which laundry is located) by supplying the cooling water in an amount that is enough only to wet the surface of the drum 200.

Meanwhile, when cooling the drum 200 by supplying cooling water to the outer circumferential surface of the drum 200 as described above, the cooling water supplied to the outer circumferential surface of the drum 200 may be introduced through the through-holes in the drum 200.

In this case, there may be a problem that the cooling water supplied to generate condensed water may come into contact with laundry to be dried and may have an effect of wetting the laundry, thereby reducing the drying effect.

Accordingly, it is possible to restrict the cooling water supplied to the outer circumferential surface of the drum 200 from flowing through the through-holes in the drum 200 by increasing the rotating speed of the drum 200. In this case, the rotating speed of the drum 200 may be set to a level at which the cooling water remaining on the outer circumferential surface of the drum 200 does not flow into the inside of the drum 200 through the through holes.

For example, it is preferable to maintain the rotating speed of the drum 200 at about 40 to 110 revolutions per minute (rpm) during the drying of laundry. More preferably, it is preferable to maintain the rotating speed of the drum 200 at about 50 to 70 rpm.

In general, when the drum 200 is rotated at a rotating speed of 110 rpm or more, the laundry in the drum 200 is rotated while being stuck to the inner circumferential surface of the drum 200. In this case, since the laundry and dry air are not effectively mixed, drying efficiency is reduced. Therefore, it is preferable to maintain the rotating speed of the drum 200 at 110 rpm or less.

That is, in order to mix the laundry with the dry air during the drying of laundry, it is desirable to maintain the rotating speed at a level at which the laundry does not stick to the inner circumferential surface of the drum 200.

In this way, in the laundry treating apparatus 1000 according to the present embodiment, the cooling water discharged from the heat exchanger 500*a* is injected into the tub 100 and is used for condensing moisture on the surface of the drum 200. Thus, it is possible to additionally remove moisture in the air, in addition to moisture condensation achieved in the duct 300*a*.

Figure 33:
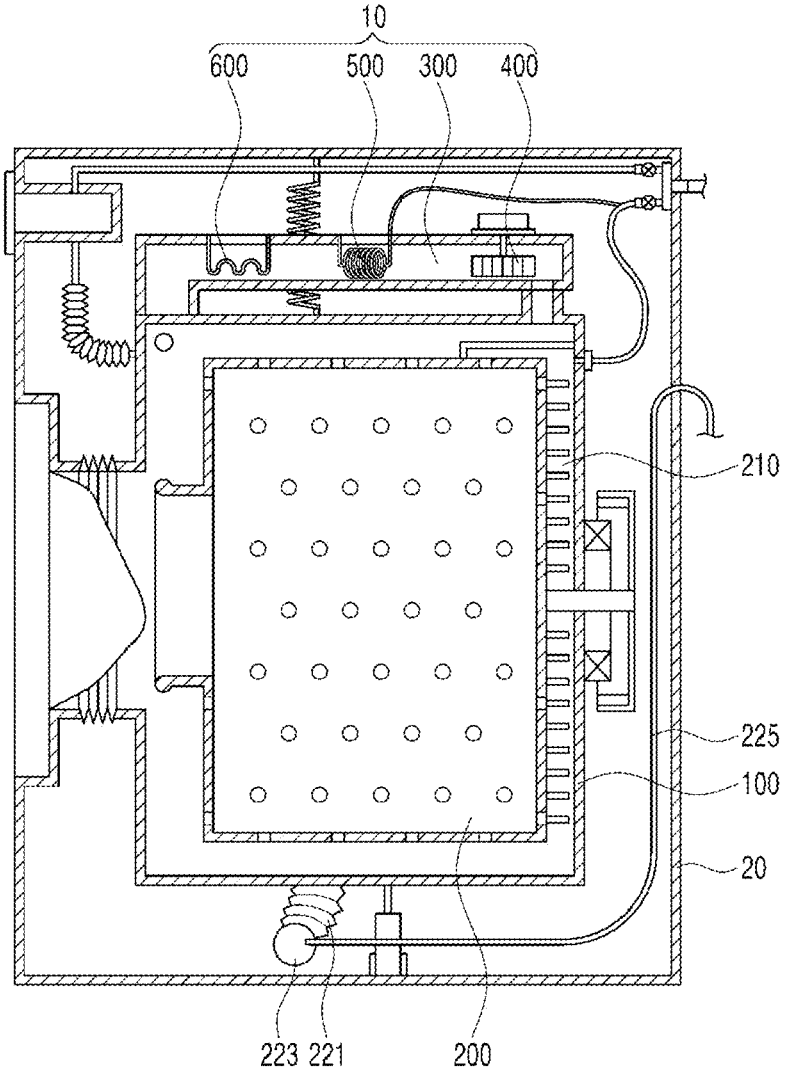
FIG. 33 illustrates the tub of the laundry treating apparatus according to an embodiment of the present disclosure.

FIG. 33 illustrates in more detail the tub of the laundry treating apparatus according to an embodiment of the present disclosure.

In the laundry treating apparatus 1000 according to an embodiment of the present disclosure, the cooling water may be injected so as to flow down along the rear surface of the tub 100. That is, due to the cooling water flowing down along the rear surface of the tub 100, the rear surface of the tub 100 may act as a condensation surface.

In this case, the cooling water flowing down along the rear surface of the tub 100 may be discharged through the discharge structure of the tub 100.

Specifically, as shown in FIG. 33, a condensation body 210 may be formed on the rear surface of the tub 100. In this case, the condensation body 210 may be provided as a plate that is bent with the same curvature as the circumferential surface of the rear surface of the tub 100, so as to correspond to the circumferential surface of the rear surface of the tub 100.

The condensation body 210 may be provided with a plurality of grooves each having a concavely bent surface, or may be provided with a plurality of protrusions each protruding from the surface of the condensation body 210. As such, since the surface area of the condensation body 210 may be increased, the dehumidification efficiency while the cooling water flows down along the rear surface of the tub 100 may be improved.

In this case, the grooves or protrusions provided on the condensation body 210 are preferably provided along a direction that is parallel to the direction from the front surface to the rear surface of the tub 100. This is in order to reduce the amount of cooling water used, by increasing the time for the cooling water supplied to the rear surface of the tub 100 to move to a first drain pipe 221 located on the bottom surface of the tub 100.

The discharge structure of the tub 100 may be configured to include a drain pump 223 positioned outside the tub 100, a first drain pipe 221 that guides the water inside the tub 100 to the drain pump 223, and a second drain pipe 225 for guiding the water discharged from the drain pump 223 to the outside of the cabinet 20.

In this way, in the laundry treating apparatus 1000 according to the present embodiment, the cooling water discharged from the heat exchanger 500*a* is guided to the rear surface of the tub 100 and is used for condensing moisture on the rear surface of the tub 100. Thus, it is possible to additionally remove moisture in the air, in addition to moisture condensation achieved in the duct 300*a*.

Figure 31:
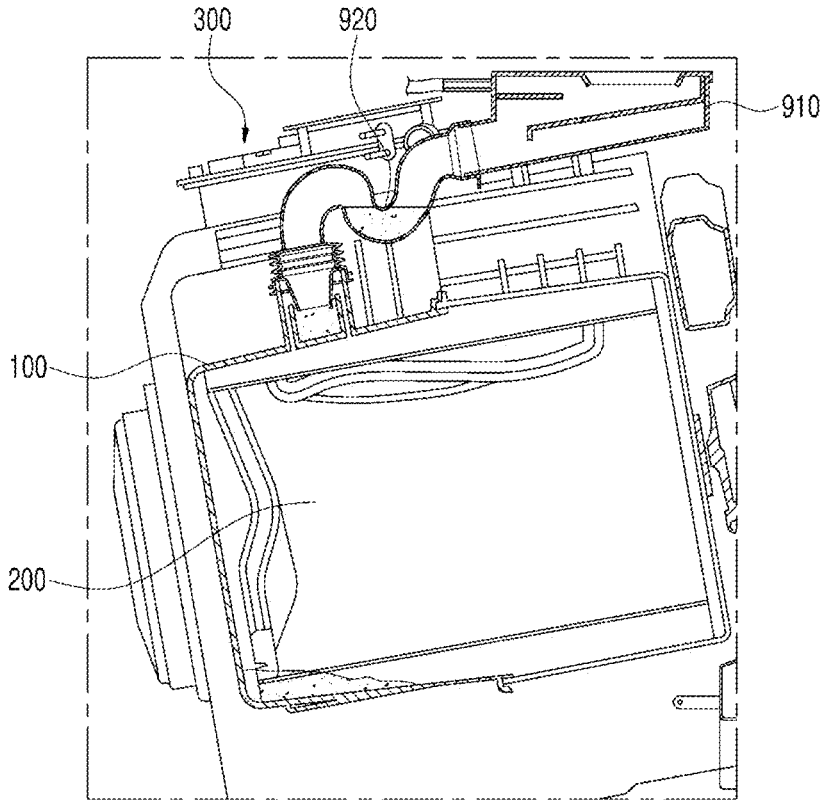
FIG. 31 illustrates a dispenser and a house trap in the laundry treating apparatus according to an embodiment of the present disclosure.

Meanwhile, as shown in FIG. 31, the water that has flowed down to the lower portion of the tub 100 may be in a collected state before being discharged through the discharge structure of the tub 100. Due to the water collected in this way, the lower surface of the tub 100 may act as condensation surface.

Accordingly, in the laundry treating apparatus 1000 according to the present embodiment, a primary condensation may be achieved through the heat exchanger 500*a*, a secondary condensation may be achieved through the water flowing down along the rear surface of the tub 100, and a tertiary condensation may be achieved through the water collected at the lower surface of the tub 100.

Figure 34:
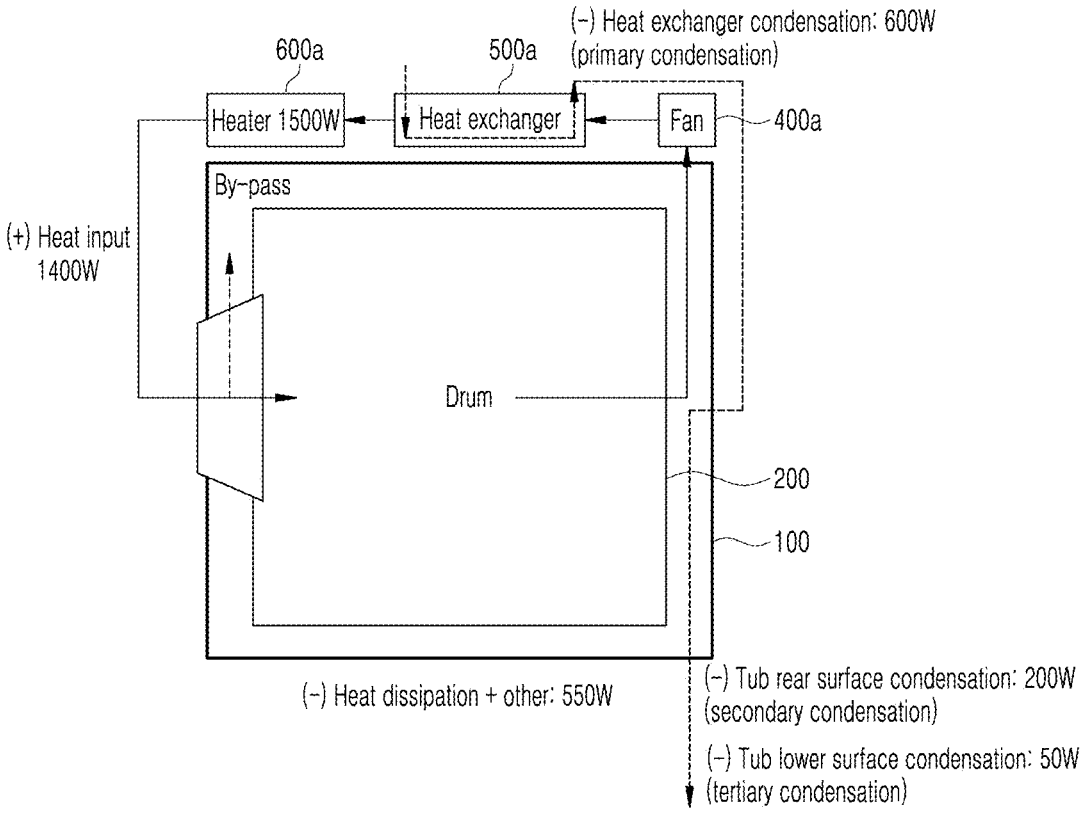
FIG. 34 schematically illustrates an example heat exchange performed in the laundry treating apparatus.

FIG. 34 illustrates an example of heat exchange performed in the laundry treating apparatus according to an embodiment of the present disclosure.

For example, when the amount of heat input is 1400 W as shown in FIG. 34, 600 W may be heat-exchanged through the primary condensation through the heat exchanger 500*a*, 200 W may be heat-exchanged through the secondary condensation of the water flowing down along the rear surface of the tub 100, and 50 W may be heat-exchanged through the tertiary condensation of the water collected at the lower surface of the tub 100. In this process, 550 W of heat loss may occur through heat dissipation and the like.

Regarding the primary condensation, the secondary condensation, and the tertiary condensation, it is preferable in consideration of the structural efficiency of the laundry treating apparatus 1000 that, relatively, primary condensation amount>secondary condensation amount>tertiary condensation amount.

As described above, in order to increase the size of the laundry treating apparatus 1000 and to implement an effective structure, there is a limitation in terms of forming a large rear surface of the tub 100. Because the amount of the secondary condensation through the water flowing down along the rear surface of the tub 100 is thus also limited, it is preferable for the primary condensation amount to be made relatively larger than the secondary condensation amount.

In addition, since it is desirable to limit the amount of water collection at the lower surface of the tub 100 in order to restrict the collected water from coming into contact with the laundry during drying, it is desirable to limit the collected water to a predetermined height only, and to discharge the water according to the performance status of each cycle.

Accordingly, there is also a limit to the amount of the tertiary condensation through the water collected at the lower surface of the tub 100, and it is preferable for the tertiary condensation amount to be made relatively smaller than the primary condensation amount and to be used only in an auxiliary manner.

In the laundry treating apparatus 1000 according to an embodiment of the present disclosure, the tub 100 may be a filter 130 that is installed in the air-intake port 110 to collect foreign substances in the air transferred to the duct 300*a*.

The air circulating in the tub 100 and the duct 300*a* for drying laundry may contain foreign substances, such as lint generated from the laundry. These foreign substances may be introduced into the duct 300*a*, and may become attached to at least one of the blower fan 400*a*, the heat exchanger 500*a*, or the heater 600*a*.

In this case, the blowing pressure of the blower fan 400*a* may be lowered or the heat exchange area on the surfaces of the heat exchanger 500*a* and the heater 600*a* may be reduced, which may cause the functions of the respective components to be deteriorated.

Therefore, it is preferable to restrict foreign substances from being introduced into the duct 300*a*, by causing the foreign substances in the air discharged from the tub 100 to be collected by a filter 130.

In this case, the filter 130 may be installed at a position exposed to the inside of the tub 100. In particular, the filter 130 may be located on the circumferential surface of the tub 100. Preferably, the filter 130 may be installed to extend along the inner circumferential surface of the tub 100 at a point where the circumferential surface of the tub 100 meets the air-intake port 110.

In this way, the laundry treating apparatus 1000 according to the present embodiment collects foreign substances in the air discharged from the tub 100 and reduces the foreign substances introduced into the duct 300*a*. Thus, it is possible to restrict the laundry drying function from being deteriorated due to the adhesion of foreign substances to main components in the duct 300*a*.

In the laundry treating apparatus 1000 according to an embodiment of the present disclosure, the tub 100 may further include a filter cleaner 140 that is installed on the air-intake port 110 and that sprays filter cleaning water to the filter 130.

In the case where the filter 130 is installed in the tub 100 as described above, when the drum 200 rotates, rotating air flow is formed around the drum 200 by the rotation. The rotating air flow collides with the filter 130, and foreign substances, such as lint collected in the filter 130, may be removed.

In addition, when wet laundry is present inside the drum 200, water from the laundry may be emitted to the inner wall surface of the tub 100 through the through-holes in the drum 200. In addition, the emitted water is capable of cleaning the filter 130 to a certain extent by colliding with the filter 130.

However, in order to more directly clean the filter 130, the filter cleaning water may be sprayed from the air-intake port 110 towards the filter 130. Since foreign substances collected in the filter 130 are removed by the spraying of the filter cleaning water, the performance of the filter 130 can be stably maintained.

In this case, the filter cleaning water may also be introduced into the tub 100 after passing through the filter 130. Accordingly, the filter cleaning water falls onto the upper outer circumferential surface of the drum 200 and lowers the temperature of the drum 200, such that the drum 200 is able to serve as a condensing plate.

In particular, the filter cleaning water is jetted at a predetermined pressure for cleaning the filter 130. The filter cleaning water jetted at a predetermined pressure is diffused by the filter 130 in the form of a mesh while passing through the filter 130, such that the surface of the drum 200 can be cooled more widely and more quickly.

As described above, the laundry treating apparatus 1000 according to the present embodiment cleans the filter 130 that collects foreign substances in the air, thereby restricting the foreign substances from accumulating in the filter 130 itself. Thus, it is possible to improve the efficiency of collecting foreign substances while causing the air circulation to be smoothly performed.

In the laundry treating apparatus 1000 according to an embodiment of the present disclosure, it is possible to supply some of the cooling water to the filter cleaner 140 so as to be used as filter cleaning water.

As described above, the cooling water discharged from the heat exchanger 500*a* may be guided into the tub 100 and treated or may cause the surface of the drum 200 to act as a condensing surface. In addition to this, the cooling water discharged from the heat exchanger 500*a* may be guided to the filter cleaner 140 and may be used for cleaning the filter 130.

Accordingly, even if a separate supply apparatus is not installed to supply filter cleaning water to the filter cleaner 140, some of the cooling water may be supplied to the filter cleaner 140 and used as the filter cleaning water.

In this way, in the laundry treating apparatus 1000 according to the present embodiment, some of the cooling water is used as filter cleaning water, without a separate component for supplying filter cleaning water to the filter cleaner 140. Thus, it is possible to further simplify the structure of the filter cleaner 140 such that the space in which the filter cleaner 140 is installed can be reduced.

Meanwhile, the laundry treating apparatus 1000 according to an embodiment of the present disclosure may further include branch pipes 710 connected to the cleaning nozzle 700*a* and the filter cleaner 140, respectively, and a branch valve 720 installed in the branch pipes 710 to adjust the supply of cleaning water to at least one of the cleaning nozzle 700*a* or the filter cleaner 140.

Specifically, as illustrated in FIG. 11, as both cleaning water used in the cleaning nozzle 700*a* and filter cleaning water used in the filter cleaner 140, washing water for laundry, cooling water discharged from the heat exchanger 500*a*, or the like may be used.

To this end, up to the water supply hose or the heat exchanger 500*a*, by connecting the branch hoses to respective branch pipes 710 connected to the cleaning nozzle 700*a* and the filter cleaner 140, some of the washing water or cooling water is supplied to the cleaner 700 and the filter cleaner 140.

In particular, each branch pipe 710 for transferring any one of washing water, cooling water, and cleaning water may be coupled to at least one branch valve 720 so as to perform control such that water is supplied to an appropriate component.

Through this, the cleaning of the filter 130 and the cleaning of the heat exchanger 500*a* may be performed simultaneously or selectively in one branch valve 720.

In particular, in the laundry treating apparatus 1000 according to an embodiment of the present disclosure, the cleaning of the cleaning nozzle 700*a* of the heat exchanger 500*a* and the cleaning of the filter cleaner 140 of the filter 130 may be performed simultaneously.

In this regard, the supply and discharge of cooling water, cleaning water, and condensed water in the laundry treating apparatus 1000 according to the present embodiment will be described with reference to FIG. 30.

When tap water or the like to be used as washing water for laundry is supplied to the laundry treating apparatus 1000, water may be simultaneously supplied to both the cleaning nozzle 700*a* and the filter cleaner 140 by any branch pipe 710.

Accordingly, the cleaning nozzle 700*a* and the filter cleaner 140 may be operated at the same time.

In addition, the water supplied to the laundry treating apparatus 1000 may be injected into the tub 100 through a dry valve or the like to condense moisture on the surface of the drum 200, and may also be supplied to the water-cooled heat exchanger 500*a* to be used as cooling water.

In this case, it is possible to reduce the diameter of the pipe supplied to the water-cooled heat exchanger 500*a* using a pipe joint structure such as a separate reducer.

In addition, the cooling water discharged from the water-cooled heat exchanger 500*a*, the condensed water condensed inside the duct 300*a*, and the cleaning water for the heat exchanger 500*a* are collected through different branch pipes 710, respectively, and may be then injected into the tub 100.

FIGS. 13 to 16 illustrate a first exemplary heat exchanger cover in the laundry treating apparatus according to an embodiment of the present disclosure. In this case, for convenience of description, the description of the first exemplary heat exchanger cover will be made with also reference to FIGS. 3 to 6.

As illustrated in FIGS. 13 to 16, the laundry treating apparatus 1000 according to an embodiment of the present disclosure may further include a cleaner 700.

The cleaner 700 is installed in the circulation flow path part 300 so as to clean the condenser 500, and removes foreign substances attached to the condenser 500 from the air discharged from the tub 100.

In this case, the cleaner 700 may be a cleaning nozzle 700*a* that is installed in the duct 300*a* so as to spray cleaning water onto the heat exchanger 500*a*, and as described herein, the cleaner 700 may include various components for removing foreign substances attached to the heat exchanger 500*a* through cleaning.

When air is circulated in the tub 100 and the duct 300*a* for drying laundry, foreign substances, such as lint in the laundry, may be introduced into the duct 300*a* together with the air. These foreign substances may become attached to at least one of the blower fan 400*a*, the heat exchanger 500*a*, or the heater 600*a* arranged inside the duct 300*a*.

In particular, as described herein, since moisture is present on the surface of the heat exchanger 500*a*, foreign substances, such as lint, may become attached more easily thereto. In addition, the foreign substances attached as described herein may interfere with heat exchange between the cooling water inside the heat exchanger 500*a* and the air on the surface of the heat exchanger 500*a*, and thus the efficiency of the heat exchanger 500*a* may be reduced.

Therefore, by spraying cleaning water onto the heat exchanger 500*a* through the cleaning nozzle 700*a* installed in the duct 300*a*, removing foreign substances attached to the heat exchanger 500*a* may improve the efficiency of drying laundry.

In this case, as the cleaning water, the above-described washing water for laundry, cooling water discharged from the heat exchanger 500*a*, or the like may be used. To this end, a branch hose may be connected up to the water supply hose or the heat exchanger 500*a* so that some of the washing water or cooling water is supplied to the cleaner 700.

In particular, each branch hose for transferring any one of washing water, cooling water, and cleaning water may be coupled to at least one branch valve so as to perform control such that water is supplied to an appropriate component according to a necessary situation.

In this way, in the laundry treating apparatus 1000 according to the present embodiment, in addition to the blower fan 400*a* and the heater 600*a*, the heat exchanger 500*a* is also installed inside the duct 300*a* installed on the tub 100, and foreign substances are removed by spraying cleaning water onto the heat exchanger 500*a*. Thus, it is possible to effectively remove the foreign substances while optimizing the structure of the duct assembly 10.

In the laundry treating apparatus 1000 according to an embodiment of the present disclosure, the duct 300*a* includes a blower fan cover 320, a heat exchanger cover 330, and a heater cover 340, which cover the blower fan 400*a*, the heat exchanger 500*a*, and the heater 600*a*, respectively. The cleaning nozzle 700*a* may be disposed on the heat exchanger cover 330 so as to spray cleaning water downwards towards the heat exchanger 500*a*.

That is, as illustrated in FIG. 4, the top surface of the duct 300*a* may be constituted by the blower fan cover 320, the heat exchanger cover 330, and the heater cover 340. In this case, the heater cover 340 is preferably made of a metal material in consideration of deformation due to heat. In addition, the blower fan cover 320 and the heat exchanger cover 330 are made of a material different from that of the heater cover 340, and may be integrated as needed.

Furthermore, since the cleaning nozzle 700*a* for cleaning the heat exchanger 500*a* is installed on the heat exchanger cover 330, the cleaner 700 may be constituted by a simpler structure without a component for installing a separate cleaning nozzle 700*a*.

In this way, in the laundry treating apparatus 1000 according to the present embodiment, since the cleaning nozzle 700*a* for cleaning foreign substances is disposed on the heat exchanger cover 330, direct cleaning of the heat exchanger 500*a* can be performed.

In the laundry treating apparatus 1000 according to an embodiment of the present disclosure, a plurality of cleaners 700 may be disposed in the top surface of the circulation flow path part 300 covering the flat surface of the condenser 500. That is, a plurality of cleaning nozzles 700*a* may be arranged in the region covering the flat surface of the heat exchanger 500*a*.

Where a heat exchange structure includes heat dissipation fins, foreign substances, such as lint, may be intensively attached only to the front side of the heat exchange structure due to relatively dense heat dissipation fins.

However, in the heat exchange structure according to the present embodiment, as described above, air passing through the inside of the duct 300*a* may smoothly pass through the entire region of the heat exchanger 500*a*. Accordingly, since foreign substances, such as lint, may be attached to the entire region of the heat exchanger 500*a*, cleaning of the entire region of the heat exchanger 500*a* may be important.

Therefore, it is desirable to evenly arrange the cleaning nozzles 700*a* over the entire region covering the flat surface of the heat exchanger 500*a*, rather than arranging the cleaning nozzles 700*a* on a specific portion.

As described above, in the laundry treating apparatus 1000 according to the present embodiment, since the plurality of cleaning nozzles 700*a* are arranged on the heat exchanger cover 330 to clean the entire flat surface of the heat exchanger 500*a*, it is possible to remove foreign substances from the entire portion in which the foreign substances accumulate.

In the laundry treating apparatus 1000 according to an embodiment of the present disclosure, the heat exchanger cover 330 may include a cleaning water inflow port 331 configured to introduce cleaning water, and cleaning flow paths 333 which are formed on the top surface of the heat exchanger cover 330 so as to be connected to respective cleaning nozzles 700*a*, and which form flow paths of cleaning water.

Figure 13:
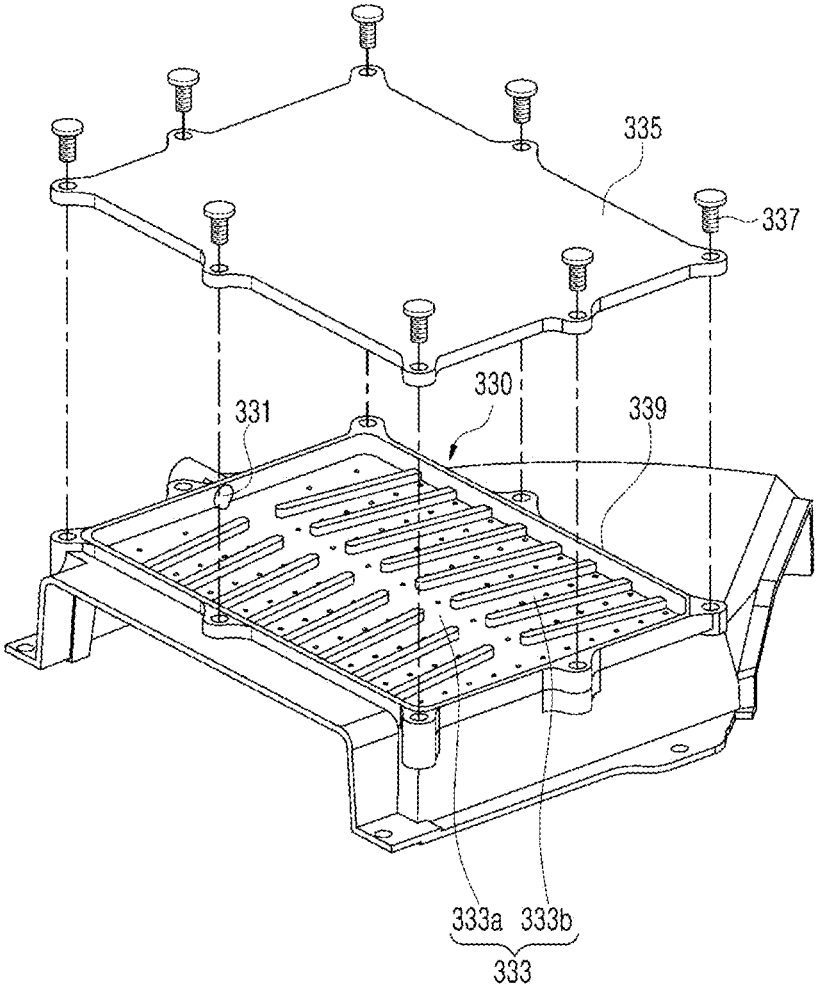
FIG. 13 is a perspective view of an example first exemplary heat exchanger cover in the laundry treating apparatus.
Figure 14:
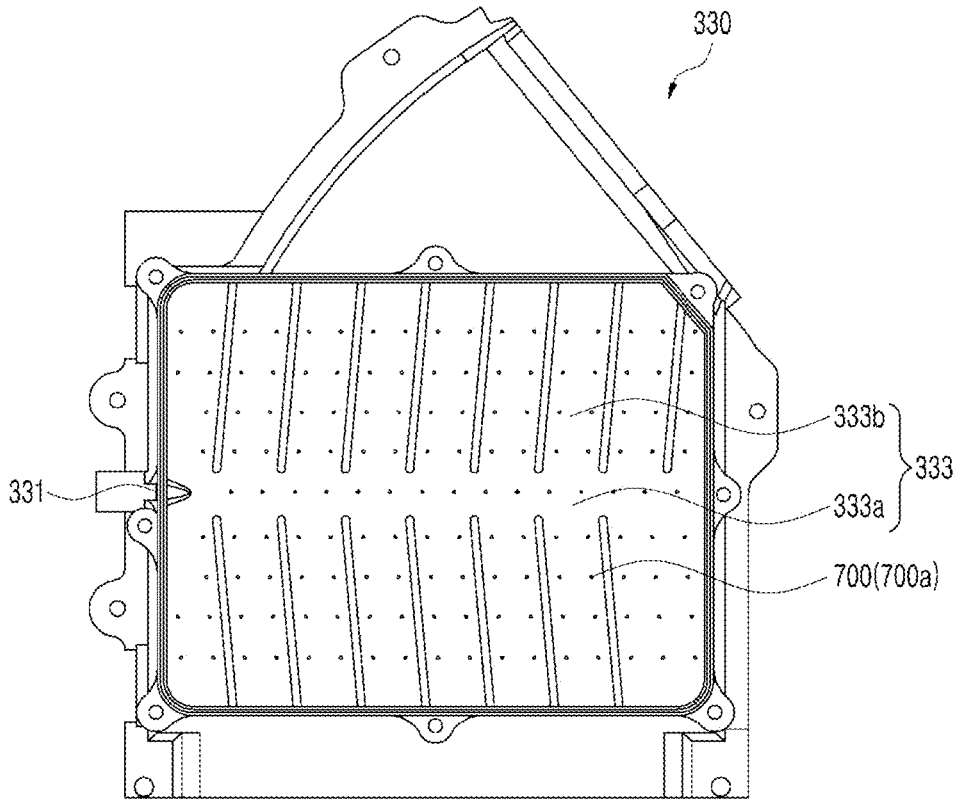
FIG. 14 is a top view of the first exemplary heat exchanger cover without a cover top plate.
Figure 15:
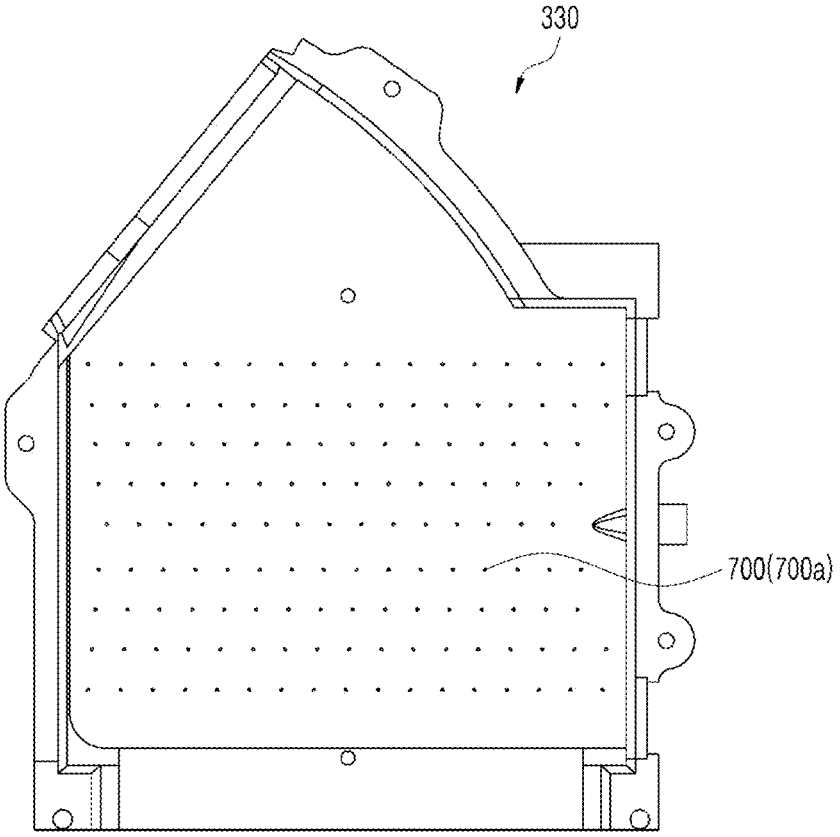
FIG. 15 is a bottom view of the first exemplary heat exchanger cover in the laundry treating apparatus.
Figure 16:
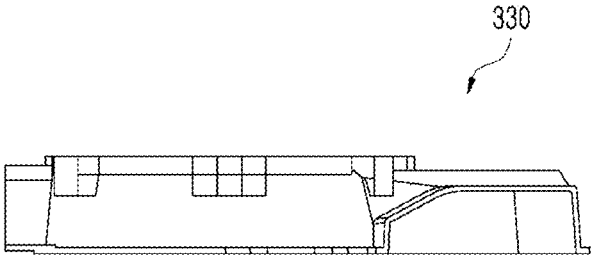
FIG. 16 is a side view of the first exemplary heat exchanger cover in the laundry treating apparatus.

That is, as illustrated in FIGS. 13 and 14, a cleaning water inflow port 331 is defined in a portion of the heat exchanger cover 330. As the number of cleaning water inflow ports 331 is increased in the heat exchanger cover 330, cleaning water may be more smoothly supplied, but as the number of cleaning water inflow ports 331 is increased, the structure of the cleaner 700 may become more complicated.

Accordingly, it is possible to cause cleaning water to be smoothly supplied to each portion through the cleaning flow paths 333 formed on the heat exchanger cover 330 after providing only one cleaning water inflow port 331.

As described above, in the laundry treating apparatus 1000 according to the present embodiment, since the cleaning water inflow port 331 and the cleaning flow paths 333 are provided in the heat exchanger cover 330, it is possible to supply cleaning water to all of the cleaning nozzles 700*a* even through one cleaning water inflow port 331.

In this case, the cleaning flow paths 333 formed in the heat exchanger cover 330 may be inclined in a shape of which the height relatively decreases in a direction away from the cleaning water inflow port 331. Accordingly, the cleaning water introduced through the cleaning water inflow port 331 may be smoothly supplied to each portion of the heat exchanger cover 330 along the inclination of the cleaning flow paths 333.

In the laundry treating apparatus 1000 according to an embodiment of the present disclosure, the cleaning flow paths 333 may include a central flow path 333*a* extending in the inflow direction of cleaning water from the cleaning water inflow port 331, and branch flow paths 333*b* from the central flow path 333*a* in a direction intersecting with the central flow path 333*a*.

That is, as illustrated in FIGS. 13 and 14, the cleaning water introduced into the cleaning water inflow port 331 flows to the central flow path 333*a* formed along the central portion to the opposite direction. In addition, the cleaning water flowing along the central flow path 333*a* may flow to each branch flow path 333*b* branched from the central flow path 333*a* so as to be dispersed over the entire region on the heat exchanger cover 330.

In this way, in the laundry treating apparatus 1000 according to the present embodiment, since the cleaning flow paths 333 include the central flow path 333*a* and the branch flow paths 333*b*, it is possible to cause the cleaning water to be supplied to all of the cleaning nozzles 700*a* without being biased to a specific portion.

In this case, as illustrated in FIGS. 13 and 14, the branch flow paths 333*b* may be formed obliquely so as to be progressively further away from the cleaning water inflow port 331 towards the outside.

Where the cleaning water flows from the central flow path 333*a* to the branch flow paths 333*b*, the flowing amount of cleaning water may decrease towards the end of each branch flow path 333*b*. Accordingly, sufficient cleaning water may not be supplied to the end of each branch flow path 333*b*.

As a result, the cleaning of the outer portion of the heat exchanger 500*a* may not be smoothly performed, and thus heat exchange efficiency may be reduced.

Accordingly, in order to prevent the above problems, the branch flow paths 333*b* may be formed obliquely, thereby causing the cleaning water introduced into the branch flow paths 333*b* to flow parallel to the direction in which the cleaning water is initially introduced from the cleaning water inflow port 331, to a certain extent.

This makes it possible to reduce, to a certain extent, a drop in the water pressure of cleaning water caused by the cleaning water hitting the walls of the branch flow paths 333*b* while flowing, thereby ensuring that the cleaning water can be supplied to the ends of the branch flow paths 333*b*.

In addition, the cleaning nozzles 700*a* connected to the branch flow paths 333*b* may be configured such that the size of a cleaning nozzle 700*a* disposed relatively closer to the outer edge is equal to or larger than the size of a cleaning nozzle 700*a* disposed relatively closer to the center.

That is, in the flowing direction of the cleaning water in each branch flow path 333*b*, the size of a cleaning nozzle 700*a* disposed at a relatively downstream side may be equal to or larger than the size of the cleaning nozzle 700*a* disposed at a relatively upstream side.

When the size of the cleaning nozzle 700*a* disposed at the upstream side is large, most of the cleaning water is discharged before reaching the cleaning nozzle 700*a* disposed at the downstream side, and thus the cleaning water may not be smoothly sprayed from the cleaning nozzle 700*a* disposed at the downstream side.

Accordingly, the cleaning nozzle 700*a* disposed at the upstream side is relatively small, and the side of the cleaning nozzle 700*a* disposed at the downstream side is equal to or relatively larger than the size of the cleaning nozzle 700*a* disposed at the upstream side, so as to ensure that the cleaning water can be supplied to the cleaning nozzle 700*a* connected at the end of the branch flow path 333*b*.

In the laundry treating apparatus 1000 according to an embodiment of the present disclosure, the cleaning power of the cleaner 700 may relatively increase towards the blower 400. That is, as a cleaning nozzle 700*a* closer to the blower fan 400*a* may have a larger cleaning water jet force.

As described above, the air introduced into the duct 300*a* through the blower fan 400*a* flows towards the heat exchanger 500*a*. Accordingly, a portion of the heat exchanger 500*a* closer to the blower fan 400*a* comes into contact with the air introduced into the duct 300*a* first.

Accordingly, more foreign substances may be attached to a portion of the heat exchanger 500*a* closer to the blower fan 400*a*. Therefore, it is preferable to more intensively clean the portion closer to the blower fan 400*a* when cleaning the heat exchanger 500*a*.

As described above, the laundry treating apparatus 1000 according to the present embodiment is configured such that, on a portion closer to the blower fan 400*a* of the heat exchanger 500*a*, foreign substances are removed with a stronger cleaning force. Thus, it is possible to efficiently remove foreign substances in consideration of the amount of foreign substances that accumulate in each portion.

Meanwhile, the cleaning power of the cleaner 700 may be different depending on the disposed position, which may result from making the open areas of the respective cleaning nozzles 700*a* different from each other, or making the spray pressures of pumps installed in the respective cleaning nozzles 700*a* different from each other.

In addition, in consideration of the central flow path 333*a* in which a relatively large amount of cleaning water flows, the cleaning water inflow port 331 directly connected to the central flow path 333*a* may be disposed to be biased towards a portion requiring a stronger cleaning power.

In the laundry treating apparatus 1000 according to an embodiment of the present disclosure, the heat exchanger cover 330 may further include a cover body 339 configured to cover the heat exchanger 500*a*, and having the cleaning flow paths 333 formed in the top surface thereof and a cover top plate 335 coupled to the cover body 339 so as to cover the top surfaces of the cleaning flow paths 333.

That is, as illustrated in FIG. 13, the heat exchanger cover 330 may include a cover body 339 and a cover top plate 335, which are detachably coupled to each other.

As described above, the cleaning flow paths 333 are defined in the top surface of the heat exchanger cover 330. In this case, when the cleaning flow paths 333 are exposed to the outside, foreign substances may accumulate in the cleaning flow paths 333, which may result in deterioration of the performance of cleaning the heat exchanger 500*a*.

Accordingly, the cleaning flow paths 333 are formed in the top surface of the heat exchanger cover 330, but it is desirable to cover the top surfaces of the cleaning flow paths 333 with a predetermined member such that the cleaning flow paths 333 are not exposed to the outside.

In view of these features, it is practically difficult to fabricate the heat exchanger cover 330 by processing a single member. This is because it is very difficult to form cleaning flow paths 333 in the top surface of the heat exchanger cover 330 made of a single member during, for example, injection molding using a mold.

Accordingly, in fabricating a heat exchanger cover 330, it is preferable to separately fabricate the cover body 339 in which the cleaning flow paths 333 are defined and the cover top plate 335 that is capable of being coupled to the top surface of the cover body 339.

In this case, the cover body 339 and the cover top plate 335 may be coupled to each other using separate fastening members 337 as illustrated in FIG. 13, but is not necessarily limited thereto, and may be detachably coupled to each other in various ways as needed.

Figure 17:
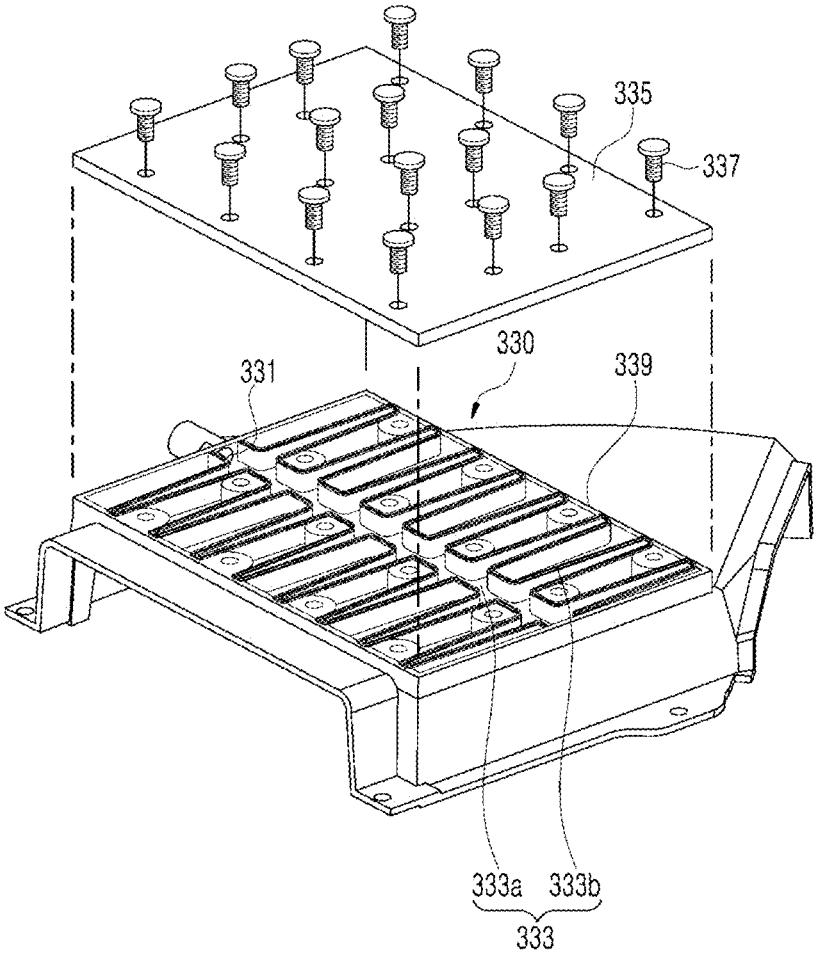
FIG. 17 is a perspective view of a second exemplary heat exchanger cover in the laundry treating apparatus.
Figure 18:
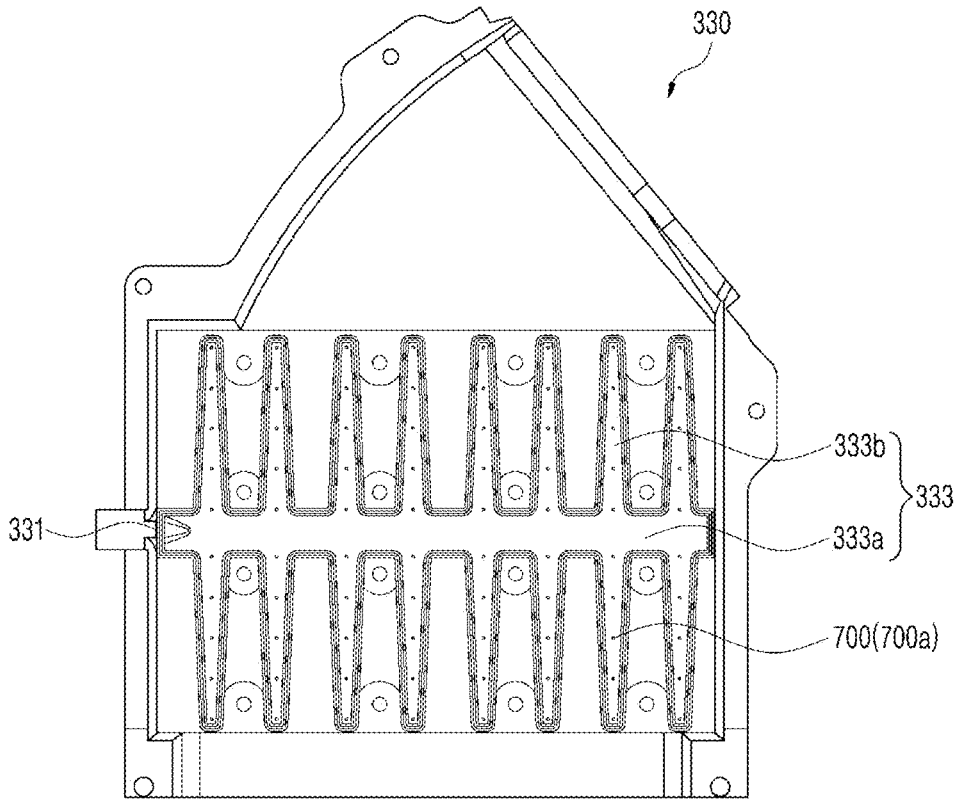
FIG. 18 is a top view of the second exemplary heat exchanger cover without a cover top plate.

FIGS. 17 and 18 illustrate a second exemplary heat exchanger cover in the laundry treating apparatus according to an embodiment of the present disclosure.

As illustrated in FIGS. 17 and 18, in the laundry treating apparatus 1000 according to an embodiment of the present disclosure, each branch flow path 333*b* may be narrower towards the outside.

As described above, sufficient cleaning water may not be supplied to the ends of the branch flow paths 333*b*, and thus the heat exchange efficiency of the heat exchanger 500*a* may be reduced.

Accordingly, by defining the branch flow paths 333*b* to be narrower towards the outside, it is possible to make cleaning water flow faster in the narrow portion. This may make it possible for the cleaning water to flow relatively quickly at the ends of the branch flow paths 333*b* so that the spray pressure for cleaning can be sufficiently secured, even when the amount of flowing cleaning water is reduced to a certain extent.

Figure 19:
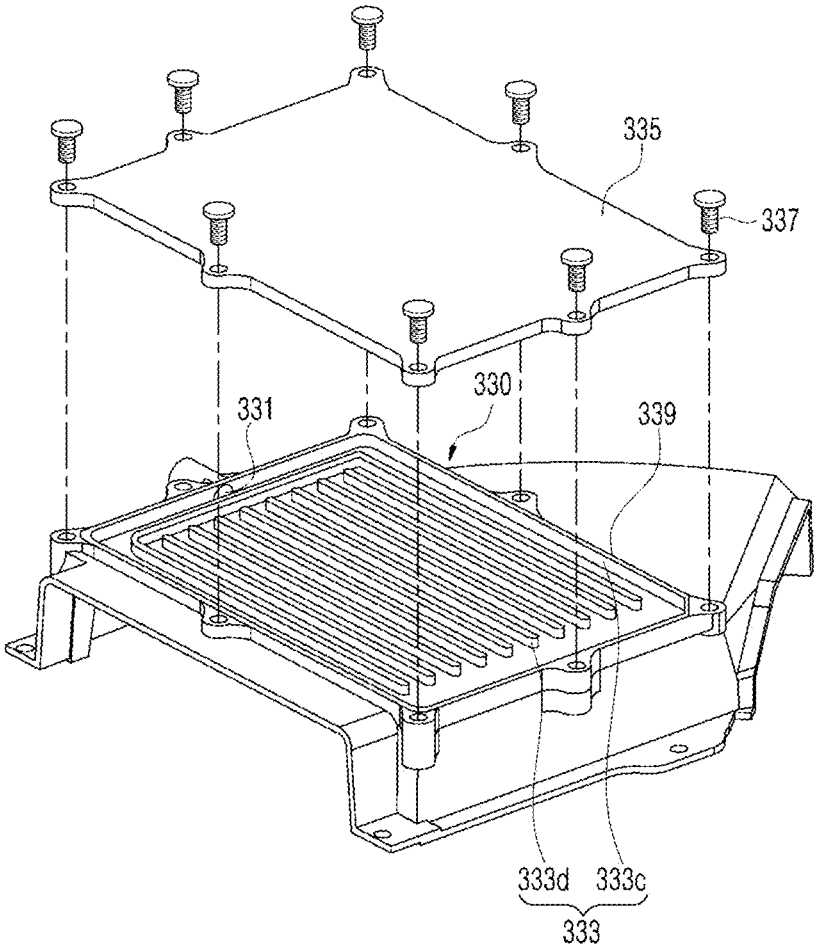
FIG. 19 is a perspective view of a third exemplary heat exchanger cover in the laundry treating apparatus.
Figure 20:
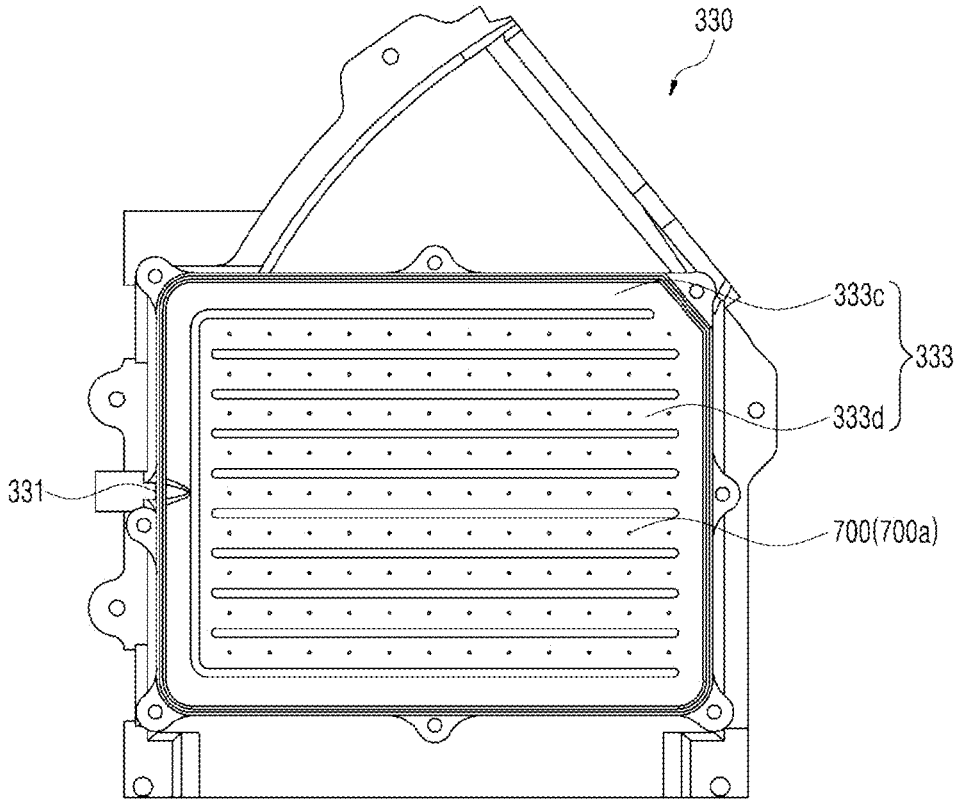
FIG. 20 is a top view of the third exemplary heat exchanger cover without a cover top plate.
Figure 21:
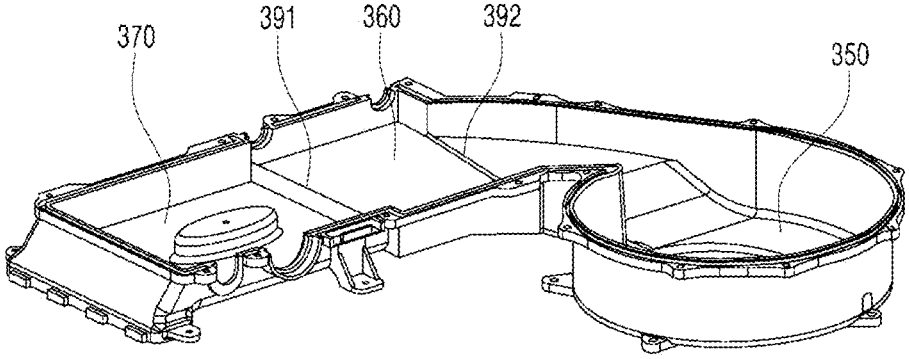
FIGS. 21 to 24 are perspective, first side, second side, and top views of a blower fan base, a heat exchanger base, and a heater base in the laundry treating apparatus.
Figure 22:
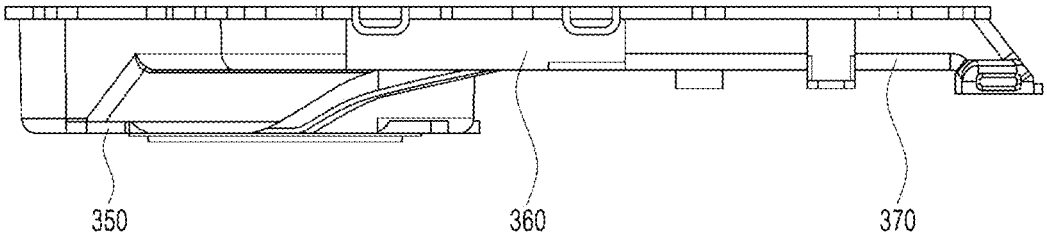
Figure 23:
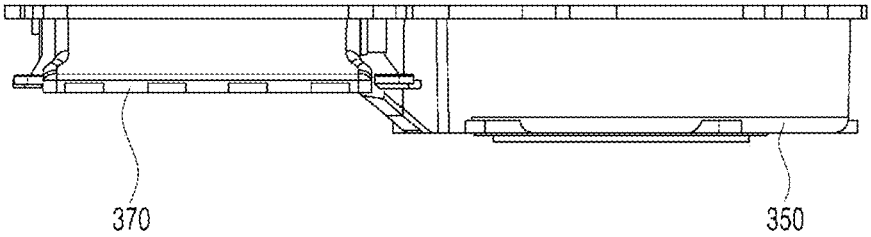

FIGS. 19 and 20 illustrate a third exemplary heat exchanger cover in the laundry treating apparatus according to an embodiment of the present disclosure.

In the laundry treating apparatus 1000 according to an embodiment of the present disclosure, the cleaning flow paths 333 may include peripheral flow paths 333*c*, each extending from the cleaning water inflow port 331 to the opposite side to the cleaning water inflow port 331 along the outer peripheral portion, and dividing flow paths 333*d*, which each extend from the opposite side to the cleaning water inflow port 331 towards the cleaning water inflow port 331 and divide the top surface of the heat exchanger cover 330.

That is, as illustrated in FIGS. 19 and 20, the cleaning water introduced into the cleaning water inflow port 331 flows in the peripheral flow paths 333*c* extending to the opposite side to the cleaning water inflow port 331 along the outer peripheral portion. In addition, the cleaning water that reaches the opposite side to the cleaning water inflow port 331 along the peripheral flow paths 333*c* flows into the dividing flow paths 333*d* so as to be dispersed over the entire region on the heat exchanger cover 330.

In particular, a plurality of peripheral flow paths 333*c* may be provided by being branched from the cleaning water inflow port 331, and the dividing flow paths 333*d* may be arranged between the plurality of peripheral flow paths 333*c*.

In this way, in the laundry treating apparatus 1000 according to the present embodiment, since the cleaning flow paths 333 include the peripheral flow path 333*c* and the dividing flow paths 333*d*, it is possible to cause the cleaning water to be supplied to all of the cleaning nozzles 700*a* without being biased to a specific portion.

In addition, the respective cleaning nozzles 700*a* connected to the dividing flow paths 333*d* may be configured such that the size of a cleaning nozzle 700*a* disposed relatively closer to the cleaning water inflow port 331 is equal to or larger than the size of a cleaning nozzle 700*a* disposed relatively closer to the opposite side to the cleaning water inflow port 331.

That is, in the flowing direction of the cleaning water in each dividing flow path 333*d*, the size of a cleaning nozzle 700*a* disposed at a relatively downstream side may be equal to or larger than the size of the cleaning nozzle 700*a* disposed at a relatively upstream side.

When the size of the cleaning nozzle 700*a* disposed at the upstream side is large, most of the cleaning water is discharged before reaching the cleaning nozzle 700*a* disposed at the downstream side, and thus the cleaning water may not be smoothly sprayed from the cleaning nozzle 700*a* disposed at the downstream side.

Accordingly, the cleaning nozzle 700*a* disposed at the upstream side is relatively small, and the side of the cleaning nozzle 700*a* disposed at the downstream side is equal to or relatively larger than the size of the cleaning nozzle 700*a* disposed at the upstream side, so as to ensure that the cleaning water can be supplied to the cleaning nozzle 700*a* connected at the end of the dividing flow path 333*d*.

In addition, the respective cleaning nozzles 700*a* may be connected to the dividing flow paths 333*d*, rather than being connected to the peripheral flow paths 333*c*.

If the cleaning nozzles 700*a* are connected to the peripheral flow paths 333*c*, a large amount of cleaning water would be discharged from the peripheral flow paths 333*c* before reaching the dividing flow paths 333*d*. However, since the peripheral flow paths 333*c* are disposed in the outer peripheral portion of the heat exchanger 500*a* in which the need for removing lint is relatively insignificant, it would not be preferable to discharge a large amount of cleaning water from the peripheral flow paths 333*c*.

Accordingly, by making the cleaning nozzles 700*a* not connected to the peripheral flow paths 333*c*, it is possible to make cleaning water flow into the dividing flow paths 333*d* without being discharged, and then be sprayed from the cleaning nozzles 700*a* connected to the dividing flow paths 333*d*.

Figure 24:
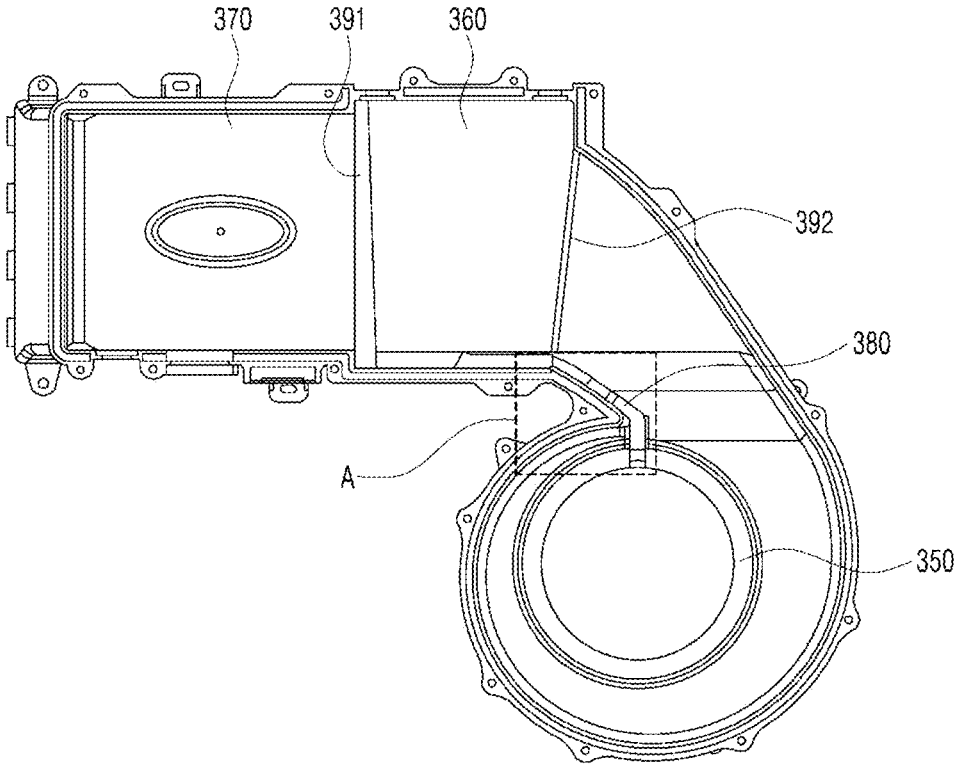
Figure 25:
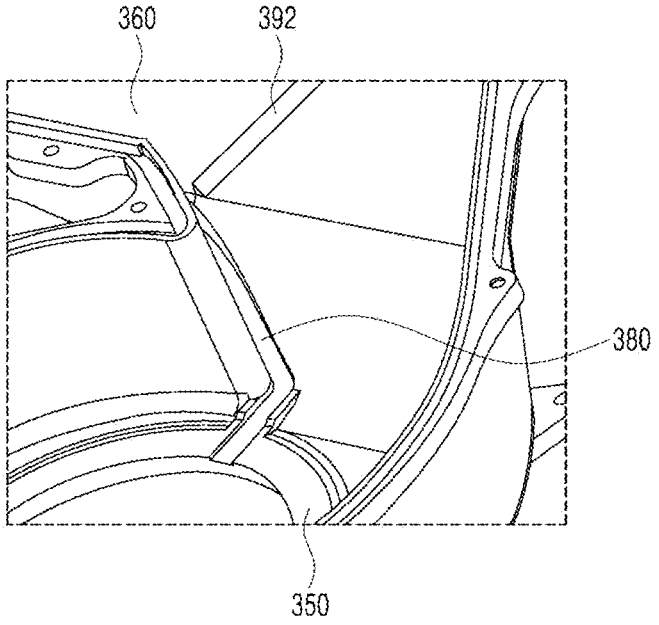
FIG. 25 is an exploded view of a part A in FIG. 24.

FIGS. 21 to 24 illustrate a blower fan base, a heat exchanger base, and a heater base in the laundry treating apparatus 1000 according to an embodiment of the present disclosure, and FIG. 25 illustrates a part A illustrated in FIG. 24 in more detail.

In the laundry treating apparatus 1000 according to an embodiment of the present disclosure, a drain path 380 may be formed in the bottom of the circulation flow path part 300 from the condenser 500 towards the center of the blower 400.

That is, the duct 300*a* may include a blower fan base 350, a heat exchanger base 360, and a heater base 370 that support respective bottom surfaces of the blower fan 400*a*, the heat exchanger 500*a*, and the heater 600*a*, and the drain path 380 may be formed from the heat exchanger base 360 towards the center of the blower fan base 350.

The cleaning water that has cleaned the heat exchanger 500*a* through the above-described processes falls to the bottom of the duct 300*a*. It is undesirable for the cleaning water that has fallen to accumulate in the duct 300*a* or to flow to other parts, such that this may impair the function of the duct assembly 10.

Therefore, it is desirable to discharge the cleaning water that has fallen to the bottom of the duct 300*a* along as quick and stable a direction as possible. To this end, by forming the drain path 380 from the heat exchanger base 360 towards the center of the blower fan base 350, it is possible to quickly and stably discharge cleaning water along the drain path 380.

In this case, the air-intake port 110 in the tub 100 is disposed at the center of the blower fan base 350, and cleaning water flowing along the drain path 380 may be introduced into the tub 100. Then, the cleaning water introduced into the tub 100 may be treated similarly to the above-described filter cleaning water.

As described above, in the laundry treating apparatus 1000 according to the present embodiment, since the drain path 380, which guides cleaning water flowing to the bottom of the duct 300*a* towards the center of the blower fan base 350, is formed, it is possible to effectively discharge the cleaning water to the outside of the duct 300*a*.

In the laundry treating apparatus 1000 according to an embodiment of the present disclosure, the circulation flow path part 300 may have a first water barrier step 391 disposed on the bottom thereof between the condenser 500 and the heating part 600. That is, the first water barrier step 391 may be disposed between the heat exchanger base 360 and the heater base 370.

It is undesirable for the cleaning water that has fallen to the bottom of the duct 300*a* after cleaning the heat exchanger 500*a* to flow towards the heater 600*a*. This is because, when the cleaning water comes into contact with the heater 600*a*, the function of the heater 600*a* for heating air may be deteriorated since the temperature of the heater 600*a* is lowered.

In addition, it is also undesirable for the condensed water condensed in the heat exchanger 500*a* to flow to the heater 600*a* separately from the cleaning water.

Accordingly, it is preferable to restrict or block the flow of condensed water or cleaning water towards the heater 600*a* using the first water barrier step 391 disposed between the heat exchanger base 360 and the heater base 370.

As described above, in the laundry treating apparatus 1000 according to the present embodiment, since the first water barrier step 391 is disposed to restrict or block the flow of condensed water or cleaning water which flows to the bottom of the duct 300*a*, towards the heater 600*a*, it is possible to restrict deterioration of the function of the heater 600*a* due to contact of condensed water or cleaning water with the heater 600*a*.

In this case, the height of the first water barrier step 391 may be relatively lower than the height from the top surface of the heat exchanger base 360 to the bottom surface of the pipe 510.

That is, the first water barrier step 391 may protrude upward only to a height that is lower than that of the pipe 510.

For the purpose of restricting or blocking condensed water or cleaning water using the first water barrier step 391, the higher the height of the first water barrier step 391 is, the more advantageous it would be. However, as the height of the first water barrier step 391 increases, the air flow area inside the duct 300*a* would decrease.

Therefore, it is desirable to limit the height of the first water barrier step 391 to a height that exhibits a water blocking function while allowing air passing through the inside of the duct 300*a* to smoothly contact the heat exchanger 500*a*.

Accordingly, by making the first water barrier step 391 protrude upwards only to a height that is lower than that of the pipe 510, it is possible to restrict a decrease in the air volume inside the duct 300*a*.

In the laundry treating apparatus 1000 according to an embodiment of the present disclosure, the bottom of the circulation flow path part 300 may be inclined from the condenser 500 towards the center of the blower 400.

That is, the heat exchanger base 360 may be inclined in one direction, and the drain path 380 may be connected to the lowest point of the heat exchanger base 360. In addition, the blower fan base 350 may be inclined toward the center thereof.

It is undesirable for cleaning water or condensed water that has fallen to the bottom of the duct 300*a* after cleaning the heat exchanger 500*a* to accumulate on the heat exchanger base 360 without being discharged. This is because foreign substances or the like may accumulate in the accumulated condensate or cleaning water, which may cause sanitation problems, such as contamination or odor.

Therefore, preferably, the heat exchanger base 360 is inclined and the drain path 380 is connected to the lowest point of the heat exchanger base 360, so that condensed water or cleaning water is quickly guided to the drain path 380.

As described above, in the laundry treating apparatus 1000 according to the present embodiment, since condensed water or cleaning water flowing to the bottom of the duct 300*a* is guided to the drain path 380 along the inclination of the heat exchanger base 360, it is possible to restrict condensate or cleaning water from accumulating in a portion of the heat exchanger base 360.

In addition, it is also undesirable for condensed water or cleaning water that has fallen to the bottom of the duct 300*a* after cleaning the heat exchanger 500*a* to accumulate on the blower fan base 350 without being discharged. This is because foreign substances or the like may accumulate in the accumulated condensate or cleaning water, which may cause sanitation problems, such as contamination or odor.

Therefore, preferably, the blower fan base 350 is inclined towards the center thereof such that condensed water or cleaning water is quickly discharged to the air-intake port 110.

As described above, in the laundry treating apparatus 1000 according to the present embodiment, since condensed water or cleaning water flowing to the bottom of the duct 300*a* is guided to the central portion of the blower fan base 350 along the inclination of the blower fan base 350, it is possible to restrict condensate or cleaning water from accumulating in a portion of the blower fan base 350.

In the laundry treating apparatus 1000 according to an embodiment of the present disclosure, a second water barrier step 392 may be disposed between the blower 400 and the condenser 500, excluding the portion in which the drain path 380 is formed on the bottom. That is, the second water barrier step 392 may be disposed between the blower fan base 350 and the heat exchanger base 360, excluding the portion in which the drain path 380 is formed.

It is desirable for cleaning water or condensed water that has fallen to the bottom of the duct 300*a* after cleaning the heat exchanger 500*a* to be guided towards the blower fan 400*a*, but it is undesirable for the cleaning water or the condensed water to flow to a portion other than the drain path 380. This is because, when condensed water or cleaning water is scattered to a portion other than the drain path 380, the condensed water or the cleaning water may not be discharged smoothly.

Therefore, it is preferable to restrict condensed water or cleaning water from being scattered to other portions, using the second water barrier step 392 disposed between the blower fan base 350 and the heat exchanger base 360.

As described above, in the laundry treating apparatus 1000 according to the present embodiment, the second water barrier step 392 is provided so as to restrict condensed water or cleaning water flowing to the bottom of the duct 300*a* from flowing towards the blower fan 400*a* rather than the drain path 380. Thus, it is possible to cause condensed water or cleaning water to be discharged through an optimal path without being scattered to other portions.

Figure 27:
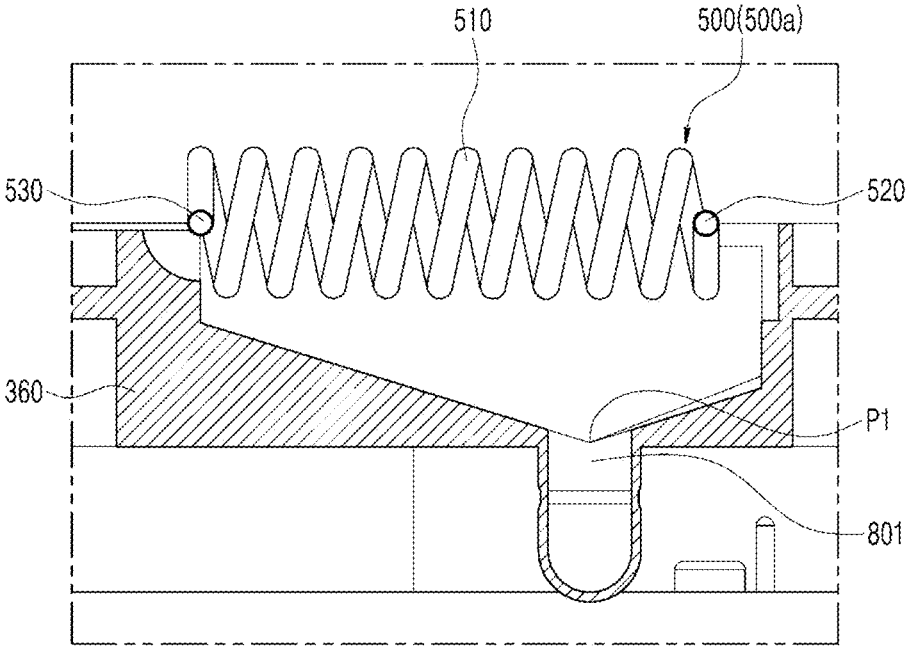
FIG. 27 is a cross sectional view of an example heat exchanger base in the laundry treating apparatus.
Figure 28:
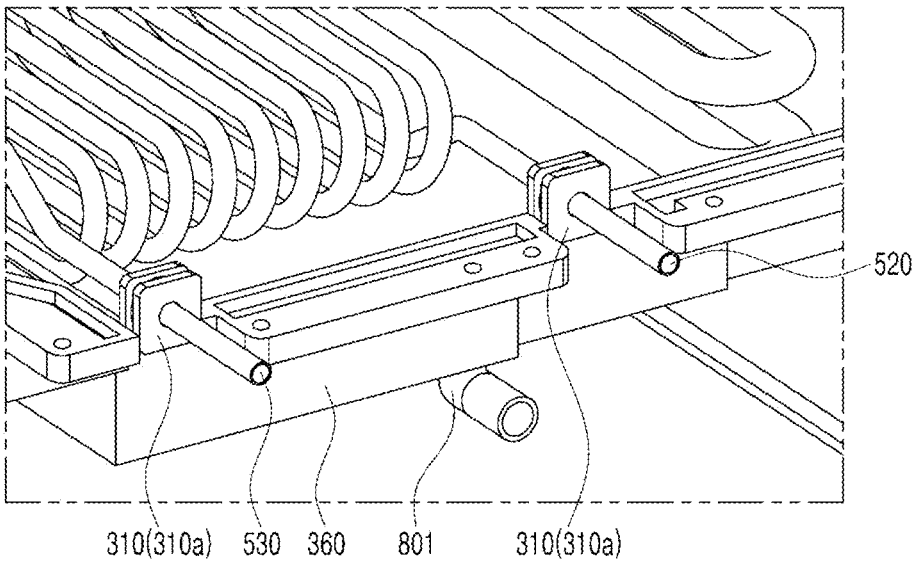
FIG. 28 is a perspective view of the heat exchanger base in the laundry treating apparatus.
Figure 29:
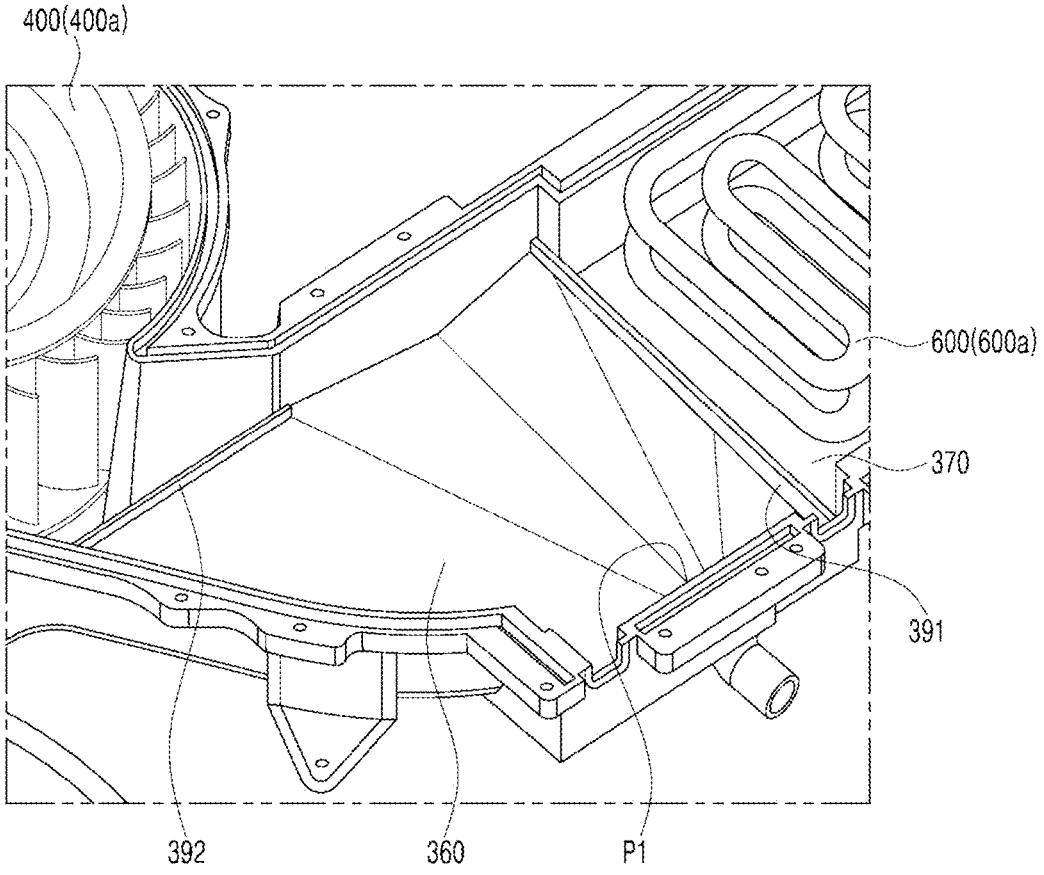
FIG. 29 is a perspective view of the heat exchanger base without a pipe.

FIGS. 27 to 29 illustrate a modification of the heat exchanger base in the laundry treating apparatus according to an embodiment of the present disclosure.

As illustrated in FIGS. 27 to 29, in the laundry treating apparatus 1000 according to an embodiment of the present disclosure, the heat exchanger base 360 may be inclined towards the first point P1 in a plan view.

In this case, the heat exchanger base 360 may have a cleaning water discharge hole 801 at the first point P1.

As described above, it is undesirable for cleaning water or condensed water that has fallen to the bottom of the duct 300*a* after cleaning the heat exchanger 500*a* to accumulate on the heat exchanger base 360 without being discharged.

In this regard, the condensed water or cleaning water may be discharged to the air-intake port 110. However, since such condensed water or cleaning water contains foreign substances such as lint, foreign substances may accumulate in the filter 130 of the air-intake port 110.

Accordingly, the condensed water or cleaning water may be guided to and discharged through the cleaning water discharge hole 801 separately defined in the heat exchanger base 360, without discharging the condensed water or cleaning water through the air-intake port 110.

Meanwhile, the cleaning water discharge hole 801 is connected to the tub 100, and the condensed water discharged from the cleaning water discharge hole 801 may be introduced into the tub 100.

This makes it possible to discharge the condensed water, which is discharged from the cleaning water discharge hole 801, using a discharge structure provided in the tub 100. Alternatively, the condensed water that is discharged from the cleaning water discharge hole 801 may be introduced into the tub 100 so as to use the condensed water to condense moisture on the surface of the drum 200. Alternatively, the condensed water that is discharged from the cleaning water discharge hole 801 may be guided to the rear surface of the tub 100 so as to use the condensed water to condense moisture on the rear surface of the tub 100.

Figure 32:
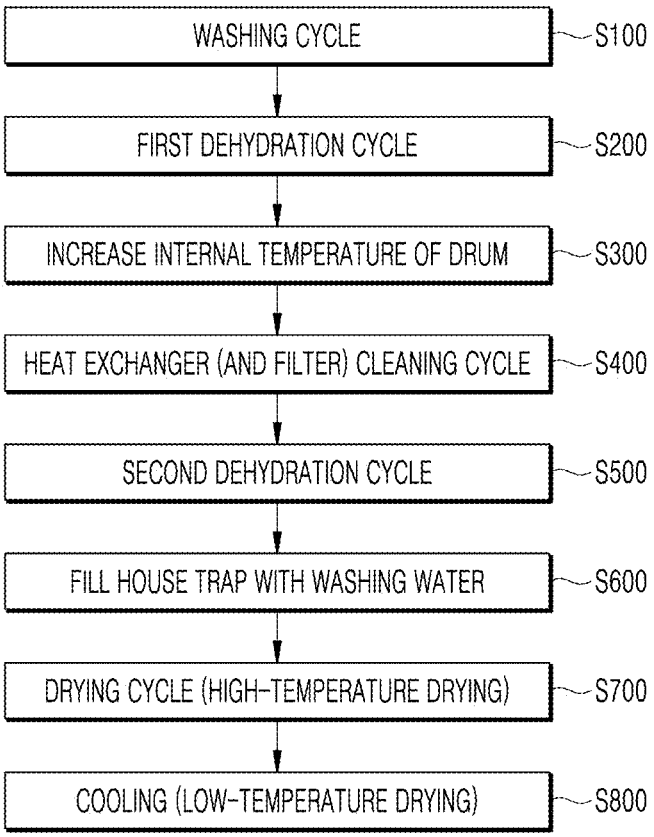
FIG. 32 is a diagram of an example algorithm for performing cycles of the laundry treating apparatus.

FIG. 32 is a diagram of an algorithm for performing cycles of the laundry treating apparatus according to an embodiment of the present disclosure.

An algorithm for performing a washing cycle, a rinsing cycle, a dehydration cycle, and a drying cycle for laundry in the laundry treating apparatus 1000 according to an embodiment of the present disclosure will be schematically described with reference to FIG. 32.

First, after the washing cycle (S100) (or the washing cycle and the rinsing cycle) for laundry is completed, in general, the dehydration cycle (S200, S500) and the drying cycle (S700, S800), for removing moisture contained in the laundry, may be sequentially performed.

However, in the laundry treating apparatus 1000 according to an embodiment of the present disclosure, the dehydration cycle may be completed after a cleaning cycle (S400) for the heat exchanger 500*a* that is performed before the drying cycle. That is, the cleaning cycle for the heat exchanger 500*a* may be performed before the drying cycle, and the dehydration cycle may be completed after the cleaning cycle.

Accordingly, in the laundry treating apparatus 1000 according to the present embodiment, a water film that may be generated during the cleaning of the heat exchanger 500*a* is removed in the dehydration cycle. Thus, it is possible to achieve smooth drying of laundry without decreasing heat exchange efficiency for drying laundry.

Meanwhile, as described above, the cleaning cycle for the heat exchanger 500*a* and the cleaning cycle for the filter 130 may be simultaneously performed. In this case, a water film that may be generated during the cleaning of the filter 130 may also be removed in the dehydration cycle.

In the laundry treating apparatus 1000 according to an embodiment of the present disclosure, in the dehydration cycle, a first dehydration (S200) of the laundry is performed, and then the internal temperature of the drum 200 is increased (S300) and a second dehydration (S500) of the laundry is additionally performed. The second dehydration of the laundry may be performed after the cleaning cycle for the heat exchanger 500*a*.

In this case, the internal temperature of the drum 200 during the second dehydration is increased in order to improve the dehydration performance by reducing the surface tension of the moisture contained in a load.

However, increasing the temperature from the time of the first dehydration can consume a significant amount of energy. Thus, after first performing the first dehydration, only the second dehydration may be performed while the temperature of the inside of the drum 200 is increased.

In particular, the second dehydration may be performed after the cleaning cycle for the heat exchanger 500*a* in order to remove the water film generated according to cleaning, as described above.

Accordingly, in the laundry treating apparatus 1000 according to the present embodiment, since the dehydration cycle is performed in two steps, and the cleaning cycle for the heat exchanger 500*a* is performed between the two steps, it is possible to remove the water film in the second dehydration step. Further, the dehydration performance can be improved under the increased temperature.

An algorithm of the drying cycle for laundry in the laundry treating apparatus 1000 according to an embodiment of the present disclosure will be described in more detail below.

When cooling water is supplied to the heat exchanger 500*a* for the drying cycle, it may be advantageous in terms of drying efficiency to continuously supply cooling water for a predetermined time.

However, if the cooling water is continuously supplied as described above, the amount of cooling water to be used would potentially be relatively large, and it would be necessary to discharge a certain amount of cooling water through the discharge structure of the tub 100 simultaneously when the cooling water is supplied.

Accordingly, in the laundry treating apparatus 1000 according to an embodiment of the present disclosure, the supply of cooling water to the heat exchanger 500*a* may be intermittently and repeatedly performed multiple times.

For example, the method of supplying cooling water to the heat exchanger 500*a* may include a process of "water supply for 7 seconds-pause for 2 seconds-water supply for 7 seconds-pause for 2 seconds-(repeated performance)".

This makes it possible to relatively reduce the amount of cooling water. Thus, even if a predetermined amount of cooling water is not discharged through the discharge structure of the tub 100 simultaneously when cooling water is supplied, contact of the cooling water contained in the tub 100 with laundry can be reduced.

Rather, since a predetermined amount of cooling water is accommodated in the tub 100, a moisture condensation effect may occur accordingly.

As described above, in the laundry treating apparatus 1000 according to the present embodiment, since the supply of cooling water to the heat exchanger 500*a* is intermittently and repeatedly performed multiple times, it is possible to achieve optimal operations, such as reducing the amount of cooling water and restricting the cooling water from coming into contact with laundry.

In the laundry treating apparatus 1000 according to an embodiment of the present disclosure, the discharge of cooling water from the tub 100 may be continuously performed for a set time. For example, a draining time may be set to 15 seconds to discharge the cooling water.

In this way, in the laundry treating apparatus 1000 according to the present embodiment, since the cooling water discharge from the tub 100 is continuously performed for a set time, it is possible to sufficiently secure a predetermined time required for discharging cooling water.

In the laundry treating apparatus 1000 according to an embodiment of the present disclosure, when cooling water is discharged to the tub 100, the supply of cooling water to the heat exchanger 500*a* may be stopped.

In this case, when a separate water level sensor is installed in the tub 100 and the amount of accommodated cooling water is detected as being more than a predetermined amount, the supply of the cooling water may be stopped and the cooling water may be discharged.

In this way, in the laundry treating apparatus 1000 according to the present embodiment, since the supply of cooling water to the heat exchanger 500*a* is stopped while the cooling water is discharged from the tub 100, the operation of each component for drying laundry can be efficiently performed.

In the laundry treating apparatus 1000 according to an embodiment of the present disclosure, a drying cycle is performed in a hot and dry state in which the heater 600*a* and the blower fan 400*a* are operated together (S700), and the supply of cooling water to the heat exchanger 500*a* may be performed after a set time elapses from the time at which the operation of the heater 600*a* and the blower fan 400*a* is initiated.

Even if the operation of the heater 600*a* and the blower fan 400*a* is initiated, the drying efficiency is not high until a predetermined time elapses. Thus, cooling water may be supplied to the heat exchanger 500*a* only when a set time elapses and when the heat exchanger 500*a* reaches the state in which moisture condensation efficiency is high.

In particular, in the laundry treating apparatus 1000 according to an embodiment of the present disclosure, the supply of cooling water to the heat exchanger 500*a* may be performed at the time at which the temperature inside the drum 200 reaches a saturated state or at the time at which the temperature inside the drum 200 reaches a set temperature.

That is, it may be possible to supply cooling water to the heat exchanger 500*a* only when the internal temperature of the drum 200 reaches a steady state to be in the saturated state after gradually increasing.

Alternatively, it may be possible to supply cooling water to the heat exchanger 500*a* only when the temperature inside the drum 200 reaches a set temperature (e.g., 93 degrees C.).

In this way, in the laundry treating apparatus 1000 according to the present embodiment, the supply of cooling water to the heat exchanger 500*a* is performed when the temperature inside the drum 200 reaches a saturated state or when the temperature inside the drum 200 reaches a set temperature, which enables each component for drying of laundry to be performed efficiently.

In the laundry treating apparatus 1000 according to an embodiment of the present disclosure, a drying cycle is additionally performed in a cool and dry state in which the heater 600*a* does not operate and the blower fan 400*a* operates (S800) (cooling process to lower the temperature inside the drum), and the supply of cooling water to the heat exchanger 500*a* may be performed until the time at which the operation of the blower fan 400*a* is terminated.

That is, even when the heater 600*a* is not in an operating state, it is possible to achieve additional condensation by operating only the blower fan 400*a* and causing the heat exchanger 500*a* to perform heat exchange. In addition, since a load temperature may be lowered according to the operation of the blower fan 400*a*, it is possible to enhance safety by ensuring that the user does not come into contact with heat.

As described above, in the laundry treating apparatus 1000 according to the present embodiment, since the supply of cooling water to the heat exchanger 500*a* is performed until the operation of the blower fan 400*a* is terminated, additional condensation is achievable even in the state in which the heater 600*a* is not operated, and the load temperature is lowered to thereby enhance safety.

An algorithm of the cleaning cycle for the heat exchanger 500*a* in the laundry treating apparatus 1000 according to an embodiment of the present disclosure will be described in more detail below.

In the laundry treating apparatus 1000 according to an embodiment of the present disclosure, the cleaning cycle for the heat exchanger 500*a* may be performed in a state in which the operation of the blower fan 400*a* is reduced.

When the blower fan 400*a* is operated at a predetermined intensity even during the cleaning cycle for the heat exchanger 500*a*, cleaning water for cleaning may be scattered by the blower fan 400*a*. In this case, when the cleaning water is scattered into the drum 200, laundry to be dried may become wet again.

Accordingly, in the laundry treating apparatus 1000 according to the present embodiment, since the cleaning of the heat exchanger 500*a* is performed in a state in which the operation of the blower fan 400*a* is reduced, it is possible to reduce the scattering of cleaning water to other portions, which results from the operation of the blower fan 400*a*.

In the laundry treating apparatus 1000 according to an embodiment of the present disclosure, when the blower fan 400*a* is not operated during the washing cycle for the heat exchanger 500*a*, each of the operation of the heater 600*a* and the supply of cooling water to the heat exchanger 500*a* may be stopped.

That is, if the blower fan 400*a* is not operated, the drying function is no longer in effect, and thus the heater 600*a* does not have to be operated. In addition, since the supply of cooling water to the heat exchanger 500*a* is also not necessary, the supply of cooling water is preferably stopped.

As described above, in the laundry treating apparatus 1000 according to the present embodiment, when the operation of the blower fan 400*a* is terminated while cleaning of the heat exchanger 500*a* is performed, each of the operation of the heater 600*a* and the supply of cooling water to the heat exchanger 500*a* is stopped. Thus, it is possible to minimize unnecessary operation in a state in which the drying function is not performed.

In the laundry treating apparatus 1000 according to an embodiment of the present disclosure, the cleaning operation for the heat exchanger 500*a* may be performed in a state in which the rotation of the drum 200 is increased.

As described above, when the cleaning water flows into the drum 200, the laundry to be dried may become wet again.

Therefore, by increasing the rotation of the drum 200 during the cleaning operation for the heat exchanger 500*a*, even if the cleaning water flows to the surface of the drum 200, it is possible to restrict the cleaning water from flowing into the drum 200, according to the rotation of the drum 200.

As described above, in the laundry treating apparatus 1000 according to the present embodiment, since the cleaning of the heat exchanger 500*a* is performed in the state in which the rotation of the drum 200 is increased, it is possible to reduce the inflow of cleaning water into the drum.

FIG. 31 illustrates a dispenser and a house trap in the laundry treating apparatus according to an embodiment of the present disclosure.

As illustrated in FIG. 31, the laundry treating apparatus 1000 according to an embodiment of the present disclosure may further include a dispenser 910 and a house trap 920.

The dispenser 910 is installed to supply an additive to the drum 200, and may be installed on a path through which washing water is supplied to the tub 100.

The house trap 920 connects the drum 200 and the dispenser 910 to each other, and defines a space in which some of the washing water is stored when the washing water supplied through the dispenser 910 flows and a washing water flowing path is sealed. By the house trap 920, detergent bubbles or air generated inside the tub 100 may be restricted from flowing back into the dispenser 910.

In this case, in the laundry treating apparatus 1000 according to an embodiment of the present disclosure, the house trap 920 may be filled with washing water between the dehydration cycle and the drying cycle (S600).

Discharging the evaporated moisture to the dispenser 910 during the drying cycle is not desirable, since it degrades drying efficiency. In particular, since the house trap 920 may be unable to perform a predetermined function due to vibration generated during the dehydration cycle, it is desirable to sufficiently supply washing water to the house trap 920 between the dehydration cycle and the drying cycle.

Accordingly, in the laundry treating apparatus 1000 according to the present embodiment, since the house trap 920 is filled with washing water before the drying cycle for laundry is performed, it is possible to restrict the moisture evaporated during the process of drying the laundry from flowing into the dispenser 910.

Although specific embodiments of the present disclosure have been described and illustrated above, it is evident to a person ordinarily skilled in the art that the present disclosure is not limited to the described embodiments, and various changes and modifications can be made without departing from the technical idea and scope of the present disclosure. Accordingly, such modifications or variations should not be understood separately from the technical spirit and viewpoint of the present disclosure, and the modifications and variations should be deemed to fall within the scope of the claims of the present disclosure.

What is claimed is:

1. A laundry treating apparatus comprising:

a tub configured to accommodate washing water;

a drum rotatably disposed inside the tub;

a duct disposed at the tub and configured to guide flow of air, the duct having (i) an air-intake port configured to receive the air from the tub and (ii) an air-inflow port configured to discharge the air to the tub;

a blower fan disposed inside the duct and configured to generate the flow of the air between the air-intake port and the air-inflow port;

a heat exchanger disposed inside the duct and configured to carry cooling water to thereby exchange heat between the cooling water and the air in the duct; and a heater disposed inside the duct and configured to heat the air in the duct, wherein the duct is attached to an upper portion of an outer circumferential surface of the tub, and wherein the heat exchanger is configured to discharge the cooling water, and the tub is configured to receive the cooling water discharged from the heat exchanger.

2. The laundry treating apparatus of claim 1, wherein the drum defines a condensation surface configured to contact the cooling water introduced into the tub.

3. The laundry treating apparatus of claim 1, wherein the tub has a rear surface configured to guide downward the cooling water introduced into the tub.

4. The laundry treating apparatus of claim 1, wherein the tub is configured to discharge the cooling water along a path through which the washing water is discharged.

5. The laundry treating apparatus of claim 1, wherein the heat exchanger comprises:

a water supply port exposed to an outside of the duct and configured to receive the cooling water; and a drain port exposed to the outside of the duct and configured to discharge the cooling water, and wherein the water supply port and the drain port are defined at one side of the duct.

6. The laundry treating apparatus of claim 5, wherein the duct further comprises a sealing disposed at an interface between the outside of the duct and each of the water supply port and the drain port.

7. The laundry treating apparatus of claim 1, wherein the heat exchanger is configured to receive a portion of the washing water and to carry the portion of the washing water as the cooling water.

8. The laundry treating apparatus of claim 7, wherein the heat exchanger defines a flow path of the cooling water that is closed and separated from a flow path of the air in the duct.

9. The laundry treating apparatus of claim 1, wherein the heat exchanger is made of a material comprising at least one of stainless steel, a copper alloy, an aluminum alloy, or a nickel alloy.

10. The laundry treating apparatus of claim 1, wherein the heat exchanger has a shape of a loop coil and is configured to condense moisture in the air in the duct based on heat exchange between the cooling water and the air in the duct.

11. The laundry treating apparatus of claim 10, wherein the heat exchanger is wound about a spiral central axis that extends in a flow direction of the air in the duct.

12. The laundry treating apparatus of claim 1, further comprising:

a cleaning nozzle disposed at an upper portion of the heat exchanger and configured to provide cleaning water toward the heat exchanger to thereby clean lint accumulated at the heat exchanger.

13. The laundry treating apparatus of claim 12, wherein the tub comprises:

a filter disposed at the air-intake port and configured to collect foreign substances in the air to be supplied to the duct; and a filter cleaner disposed at the air-intake port and configured to spray filter washing water to the filter.

14. The laundry treating apparatus of claim 13, wherein the filter cleaner is configured to receive a portion of the cooling water and to spray the portion of the cooling water as the filter washing water.

15. The laundry treating apparatus of claim 13, further comprising:

branch pipes connected to the cleaning nozzle and the filter cleaner, respectively; and a branch valve disposed between the branch pipes and configured to control supply of the washing water to at least one of the cleaning nozzle or the filter cleaner.

16. The laundry treating apparatus of claim 13, wherein the cleaning nozzle and the filter cleaner are configured to operate simultaneously to thereby clean the heat exchanger and the filter.

17. The laundry treating apparatus of claim 1, wherein the air-inflow port is connected to a front portion of the tub, and the air-intake port is connected to a rear portion of the tub.

18. The laundry treating apparatus of claim 1, wherein the heater is disposed between the air-inflow port and the heat exchanger, and wherein the heat exchanger is disposed between the heater and the blower fan.

19. The laundry treating apparatus of claim 5, wherein the air-intake port is disposed closer to the drain port than to the water supply port, and wherein the air-inflow port is disposed closer to the water supply port than to the drain port.

20. The laundry treating apparatus of claim 1, wherein the duct is in contact with the outer circumferential surface of the tub, and wherein the heat exchanger is disposed above the tub and forward relative to a rear surface of the tub.

* * * * *